US005250376A

United States Patent [19]

Kato et al.

[11] Patent Number: 5,250,376

[45] Date of Patent: Oct. 5, 1993

[54] ELECTROPHOTOGRAPHIC LITHOGRAPHIC PRINTING PLATE

[75] Inventors: Eiichi Kato; Akio Oda; Hiroshi Tashiro, all of Shizuoka, Japan

[73] Assignee: Fuji Photo Film Co., Ltd., Kanagawa, Japan

[21] Appl. No.: 943,520

[22] Filed: Sep. 11, 1992

[30] Foreign Application Priority Data

Sep. 13, 1991 [JP] Japan ..... 3-234526
Oct. 15, 1991 [JP] Japan ..... 3-266398
Nov. 13, 1991 [JP] Japan ..... 3-297244

[51] Int. Cl.[5] ..... G03G 5/087

[52] U.S. Cl. ..... 430/49; 430/96; 430/302

[58] Field of Search ..... 430/49, 302, 96

[56] References Cited

U.S. PATENT DOCUMENTS 4,952,475 8/1990 Kato et al. ..... 430/49
4,968,572 11/1990 Kato et al. ..... 430/49
4,971,870 11/1990 Kato et al. ..... 430/49
4,977,049 12/1990 Kato ..... 430/49
5,009,975 4/1991 Kato et al. ..... 430/49
5,041,348 8/1991 Kato et al. .
5,049,463 9/1991 Kato et al. ..... 430/49
5,053,301 10/1991 Kato et al. ..... 430/49
5,063,130 11/1991 Kato et al. ..... 430/49
5,077,165 12/1991 Kato et al. ..... 430/49
5,084,367 1/1992 Kato et al. ..... 430/49
5,134,051 7/1992 Kato et al. ..... 430/49

*Primary Examiner*—John Kight, III
*Assistant Examiner*—Duc Truong
*Attorney, Agent, or Firm*—Sughrue, Mion, Zinn, Macpeak & Seas

[57] ABSTRACT

An electrophotographic lithographic printing plate, in which the effect by the hydrophilic property of non-image areas is further improved, and which is stable during storage even under very severe conditions and capable of readily realizing the hydrophilic property in a short time during processing of rendering hydrophilic is provided by a process for the production of an electrophotographic lithographic printing plate, comprising subjecting an electrophotographic photoreceptor to imagewise exposure and forming a toner image, the electrophotographic photoreceptor comprising an electroconductive support having provided thereon at least one photoconductive layer containing photoconductive inorganic compound and a binder resin, the binder resin comprising at least one resin (P) as defined herein, and optionally at least one crosslinking agent, and then subjecting a non-image area of the photoconductive layer to an oil-desensitizing processing with a processing solution containing a hydrophilic compound containing a substituent having a Pearson's nucleophilic constant n of at least 5.5.

9 Claims, No Drawings

ELECTROPHOTOGRAPHIC LITHOGRAPHIC PRINTING PLATE

BACKGROUND OF THE INVENTION

1. Field of the Invention

This invention relates to an electrophotographic lithographic printing plate made by an electrophotographic system and a process for the production of the same and more particularly, it is concerned with an improvement in a photoconductive layer forming composition for the lithographic printing plate, and in an oil-desensitizing processing method.

2. Description of the Prior Art

A number of offset masters for directly producing printing plates have hitherto been proposed and some of them have already been put into practical use. Widely employed among them is a system in which a photoreceptor comprising a conductive support having provided thereon a photoconductive layer mainly comprising photoconductive particles, for example, of zinc oxide and a resin binder is subjected to an ordinary electrophotographic processing to form a highly lipophilic toner image on the surface of the photoreceptor, followed by treating the surface with an oil-desensitizing solution referred to as an etching solution to selectively render non-image areas hydrophilic and thus obtain an offset printing plate.

Requirements of offset masters for obtaining satisfactory prints include (1) an original should be reproduced faithfully on the photoreceptor; (2) the surface of the photoreceptor has affinity with an oil-desensitizing solution so as to render non-image areas sufficiently hydrophilic, but, at the same time, has resistance to solubilization; and (3) a photoconductive layer having an image formed thereon is not released during printing and is well receptive to dampening water so that the non-image areas retain the hydrophilic properties sufficiently to be free from stains even upon printing a large number of prints.

It is known that these properties are affected by the ratio of zinc oxide to a resin binder in the photoconductive layer. For example, if the ratio of a binder resin to zinc oxide particles is decreased, oil-desensitivity of the surface of the photoconductive layer is increased to reduce background stains, but, on the other hand, the internal cohesion of the photoconductive layer per se is weakened, resulting in reduction of printing durability due to insufficient mechanical strength. If the ratio of a binder resin to zinc oxide particles is increased, on the other hand, printing durability is improved, but background staining becomes conspicuous. It is a matter of course that the background staining is a phenomenon associated with the degree of oil-desensitization achieved and it has been made apparent that the oil-desensitization of the photoconductive layer surface depends on not only the binder resin/zinc oxide ratio in the photoconductive layer, but also the kind of the binder resin used to a great extent.

Resin binders which have been conventionally known include silicone resins (see Japanese Patent Publication No. 6670/1959), styrene-butadiene resins (see Japanese Patent Publication No. 1950/1960), alkyd resins, maleic acid resins, polyamides (see Japanese Patent Publication No. 11219/1960), vinyl acetate resins (see Japanese Patent Publication No. 2425/1966), vinyl acetate copolymer resins (see Japanese Patent Publication No. 2426/1966), acrylic resins (see Japanese Patent Publication No. 11216/1960), acrylic ester copolymer resins (see Japanese Patent Publication Nos. 11219/1960, 8510/1961, and 13946/1966), etc. However, electrophotographic light-sensitive material using these known resins suffer from one or more of several disadvantages, such as 1) low charging characteristics of the photoconductive layer, 2) poor quality of a reproduced image (particularly dot reproducibility or resolving power), 3) low sensitivity to exposure; 4) insufficient oil-desensitization attained by oil-desensitization for use as an offset master (which results in background stains on prints when used for offset printing), 5) insufficient film strength of the light-sensitive layer (which causes release of the light-sensitive layer during offset printing and failure to obtain a large number of prints), 6) susceptibility of image quality to influences of environment at the time of electrophotographic image formation (such as high temperature and high humidity), and the like.

For particular use as an offset master, occurrence of background stains due to insufficient oil-desensitivity presents a serious problem. In order to solve this problem, various resins for binding zinc oxide have been proposed, including resins of $\overline{M}w$ $1.8-10\times10^{-4}$ and Tg 10°-80° C. obtained by copolymerizing (meth)acrylate monomers and other monomers in the presence of fumaric acid in combination with copolymers of (meth)acrylate monomers and other monomers than fumaric acid, as disclosed in Japanese Patent Publication No. 31011/1975; terpolymers each containing a (meth)acrylic acid ester unit having a substituent having carboxylic acid group at least 7 atoms distant from the ester linkage, as disclosed in Japanese Patent Laid-Open Publication No. 54027/1978; tetra- or pentamers each containing an acrylic acid unit and hydroxyethyl (meth)acrylate unit, as disclosed in Japanese Patent Laid-Open Publication Nos. 20735/1979 and 202544/1982; terpolymers each containing a (meth)acrylic acid ester unit having an alkyl group having 6 to 12 carbon atoms as a substituent and a vinyl monomer containing carboxylic acid group, as disclosed in Japanese Patent Laid-Open Publication No. 68046/1983; and the like. These resins function to improve the oil-desensitivity of photoconductive layers.

Nevertheless, evaluation of such resins as noted above for improving the oil-desensitization indicates that none of them is completely satisfactory in terms of stain resistance, printing durability and the like.

Furthermore, it has hitherto been studied to use resins having functional groups capable of forming hydrophilic groups through decomposition such as a binder resin, for example, those having functional groups capable of forming hydroxyl groups through decomposition as disclosed in U.S. Pat. Nos. 4,929,526, 4,996,121 and 5,001,029 and those having functional groups capable of forming carboxyl groups through decomposition as disclosed in U.S. Pat. Nos. 4,792,511, 4,910,112, 5,017,448, and 4,960,661.

These resins are those which form hydrophilic groups through hydrolysis or hydrogenolysis with an oil-desensitizing solution or dampening water used during printing. When using them as a binder resin for a lithographic printing plate precursor, it is possible to avoid various problems, e.g., deterioration of smoothness, deterioration of electrophotographic properties such as dark charge retention and photosensitivity, etc., which are considered to be caused by strong interaction of the hydrophilic groups and surfaces of photoconductive zinc oxide particles in the case of using resins intrinsically having hydrophilic groups per se, and at the same time, a number of prints with clear image quality and without background stains can be obtained, since the hydrophilic property of non-image areas rendered hydrophilic with an oil-desensitizing solution is further increased by the above described hydrophilic groups formed through decomposition in the resin to make clear the lipophilic property of image areas and the hydrophilic property of non-image areas and to prevent the non-image areas from adhesion of a printing ink during printing.

In the resin of such a type as to form a hydrophilic group by the above described decomposition reaction, the carboxyl group or hydroxyl group previously masked with a protective group is subjected to decomposition reaction with a processing solution to release the protective group. For the binder resin of this type, therefore, it is required, as important properties, that during storage, the resin is stably present without being hydrolyzed due to the humidity (moisture) in the air and during processing for rendering hydrophilic, the protective group removing reaction rapidly proceeds to form a hydrophilic group and the hydrophilic property of non-image areas can be improved.

SUMMARY OF THE INVENTION

It is an object of the present invention to provide an electrophotographic lithographic printing plate, whereby the disadvantages of the prior art, as described above, can be overcome.

It is another object of the present invention to provide a lithographic printing plate, in which a binder resin for forming a photoconductive layer is improved.

It is a further object of the present invention to provide an electrophotographic lithographic printing plate, in which the effect by the hydrophilic property of non-image areas is further improved, and which is stable during storage even under very severe conditions and capable of readily realizing the hydrophilic property in a short time during processing for rendering hydrophilic.

These objects can be attained by a process for the production of an electrophotographic lithographic printing plate, comprising subjecting an electrophotographic photoreceptor to imagewise exposure and forming a toner image, said electrophotographic photoreceptor comprising an electroconductive support having provided thereon at east one photoconductive layer containing photoconductive inorganic compound and a binder resin, the binder resin comprising at least one of the following resins [P], optionally at least one of the following resins [B] and optionally at least one crosslinking agent, and then subjecting a non-image area of the photoconductive layer to an oil-desensitizing processing with a processing solution containing a hydrophilic compound containing a substituent having a Pearson's nucleophilic constant n of at least 5.5:

Resin [P]

Resin containing at least one of polymeric components each containing a functional group represented by the following General Formula ($I_0$):

General Formula ($I_0$):

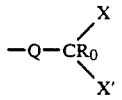

wherein X and X' are same or different groups at least one of which is an electron-attractive group and which have a sum of Hammet $\sigma_p$ values of at least 0.45, Q is COO or $SO_2$ and $R_0$ is hydrogen atom or an alkyl group having 1 to 6 carbon atoms, and Resin [B]

Heat and/or light-hardenable resin.

DETAILED DESCRIPTION OF THE INVENTION

In General Formula ($I_0$), in particular, when Q is COO, it is called General Formula (I) and when Q is $SO_2$, it is called General Formula (II).

In the present invention, Resin [P] containing at least one of polymeric components each having a functional group represented by the above described General Formula ($I_0$) can previously be crosslinked, and in this case, the resin preferably has a water resisting property when the resin is reacted with a hydrophilic processing solution.

The resin containing at least one of polymeric components each having a functional group represented by the above described General Formula ($I_0$) can be a resin containing at least one of functional groups capable of causing a hardening reaction by heat and/or light.

The feature of the electrophotographic lithographic printing plate according to the present invention consists in that at least a part of the binder resin in the photoconductive layer comprises Resin [P] containing at least one of functional groups represented by the above described General Formula ($I_0$), optionally at least one of Resin [B] consisting of a heat and/or light hardenable resin and optionally at least one crosslinking agent, and when processing with a processing solution containing at least one hydrophilic compound with nucleophilic reactivity, the hydrophilic compound can be introduced into the resin, whereby the binder resin can reveal hydrophilic property while simultaneously, it is rendered not or hardly soluble in water.

Thus, the lithographic printing plate of the present invention has various advantages that an image faithful to an original can be reproduced without occurrence of background stains owing to the high hydrophilic property of non-image areas, the smoothness and electrostatic characteristics of the photoconductive layer are excellent and furthermore, the durability is improved.

In addition, the present invention provides a lithographic printing plate precursor utilizing an electrophotographic photoreceptor comprising an electroconductive support having provided thereon at least one photoconductive layer containing photoconductive inorganic compound and a binder resin, the binder resin containing at least one resin containing at least one of polymeric components each containing a functional group represented by the following General Formula (II):

General Formula (II)

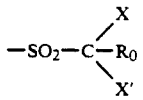

wherein X and X' are same or different groups at least one of which is an electron-attractive group and which have a sum of Hammet $\sigma_p$ values of at least 0.45, and $R_0$ is hydrogen atom or an alkyl group having 1 to 6 carbon atoms.

In the present invention, a resin containing at least one of polymeric components each having a functional group represented by the above described General Formula (II) can previously be crosslinked, and in this case, the resin preferably has a water resisting property when the resin is reacted with a hydrophilic processing solution to realize hydrophilicity.

The resin containing at least one of polymeric components each having a functional group represented by the above described General Formula (II) can be a resin containing at least one of functional groups capable of causing a hardening reaction by heat and/or light.

The mechanism that the binder resin of the present invention is rendered hydrophilic is shown by the following reaction formula (1). In the reaction formula (1), a substitution reaction rapidly takes place with a nucleophilic and hydrophilic compound excellent in nucleophilic property. However, this reaction is effective when X and X' have a sum of Hammet $\sigma_p$ values of at least 0.45, but no sufficient reactivity cannot be obtained when less than 0.45.

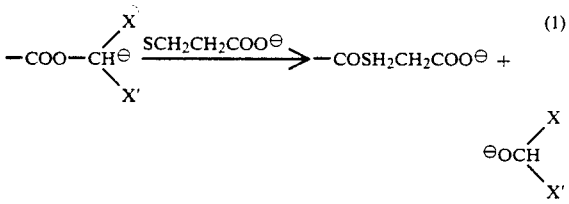

(1)

That is, in the present invention, the reactivity is largely improved by using a nucleophilic and hydrophilic compound while suppressing the reaction with moisture in the air more than in the prior art, when a non-image area, as a lithographic printing plate, is subjected to oil-desensitizing processing.

The hydrophilic group is introduced to render a binder resin hydrophilic by the above described mechanism.

Resin [P] containing at least a copolymeric component containing the functional group represented by General Formula (I) will now be illustrated in detail.

X and X' represented in General Formula (I) can be groups at least one of which is an electron-attractive group and which have a sum of Hammet $\sigma_p$ values of at least 0.45. Examples of the electron-attractive group are acyl groups, aroyl groups, formyl group, alkoxycarbonyl groups, phenoxycarbonyl group, alkylsulfonyl groups, aroylsulfonyl groups, nitro group, cyano group, halogen atoms, halogenated alkyl groups, carbamoyl group and the like.

Hammet $\sigma_p$ values is ordinarily used as an index to estimate the degree of attracting or donating electrons of a substituent and when this value is the larger at + side, the substituent is handled as a strong electron attractive group. The specific numerals for the substituents are mentioned in Naoki Inamoto, "Hammet Rule -Structure and Reactivity-" published by Maruzen KK (1984).

It is considered that the Hammet $\sigma_p$ has additivity in this system and both of X and X' are not always required to be electron attracting groups. When one of X and X', i.e. X is an electron attracting group, therefore, the other substituent X' is not particularly limited, but can be any substituent having a sum of $\sigma_p$ of X and X' in the range of at least 0.45.

Specific, but not limiting, examples of the copolymer constituent containing the functional group represented by General Formula (I) include those represented by the following repeating unit of General Formula (III):

General Formula (III)

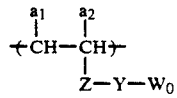

wherein Z represents —COO—, —OCO, —O—, —CO—,

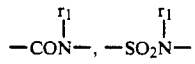

wherein $r_1$ represents hydrogen atom or a hydrocarbon group, —CONHCOO—, —CONHCONH—, —$CH_2$COO—, —$CH_2$OCO— or

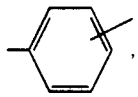

Y represents a direct bond or organic radical for connecting —Z— and —$W_o$, —Z—Y— can directly connect

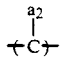

and —$W_o$, $W_o$ represents the functional group represented by General Formula (I) and $a_1$ and $a_2$ may be same or different, each being hydrogen atom, a halogen atom, cyano group, an alkyl group or an aryl group.

General Formula (III) will now be illustrated in detail. In this formula, Z represents preferably

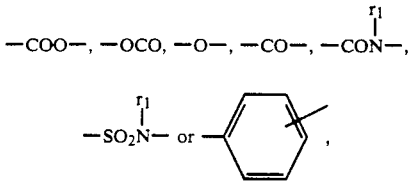

wherein $r_1$ represents hydrogen atom, an optionally substituted alkyl group of 1 to 8 carbon atoms, such as methyl, ethyl, propyl, butyl, pentyl, hexyl, octyl, 2-chloroethyl, 2-bromoethyl, 2-cyanoethyl, 2-methoxyethyl, 2-hydroxyethyl, 3-bromopropyl groups etc., an optionally substituted aralkyl group of 7 to 9 carbon atoms, such as benzyl, phenethyl, 3-phenylpropyl, chlorobenzyl, bromobenzyl, methylbenzyl, methoxybenzyl, chloromethylbenzyl, dibromobenzyl groups, etc., an optionally substituted aryl group such as phenyl, tolyl, xylyl, mesityl, methoxyphenyl, chlorophenyl, bromophenyl, chloromethylphenyl groups, etc.

Y represents a direct bond or an organic radical for connecting —Z— and —$W_o$. When Y represents the organic radical, this radical is a carbon-carbon bond, between which hetero atoms (including oxygen, sulfur and nitrogen atom) may be present, which specific examples include

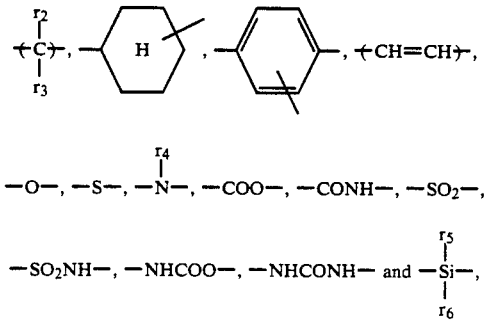

individually or in combination of these groups, wherein $r_2$, $r_3$, $r_4$, $r_5$ and $r_6$ have the meaning as the foregoing $r_1$.

$a_1$ and $a_2$ may be the same or different, each being a hydrogen atom, a halogen atom (e.g., chlorine, bromine), a cyano group, a hydrocarbon residue (e.g., an optically substituted alkyl group containing 1 to 12 carbon atoms, such as methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, butoxycarbonylmethyl, etc., an aralkyl group such as benzyl, phenetyl, etc., and an aryl group such as phenyl, tolyl, xylyl, chlorophenyl, etc.

In addition, the linkage moiety —Z—Y— in General Formula (III) may directly connect the moiety

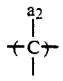

to the moiety —$W_o$.

A binder resin containing the functional group represented by General Formula (II) will now be illustrated.

The functional group of General Formula (II) is characterized by reacting with a nucleophilic and hydrophilic compound (nucleophilic reagent) by an oil-desensitizing treatment to form sulfinic group.

X and X' in General Formula (II) can be groups at least one of which is an electron-attractive group and may be same or different if having a sum of Hammet $\sigma_p$ values of at least 0.45.

Hammet $\sigma_p$ value is ordinarily used as an index to estimate the degree of attracting or donating electrons of a substituent and when this value is the larger at + side, the substituent is handled as a strong electron attractive group. The specific numerals for the substituents are mentioned in Naoki Inamoto, "Hammer Rule -Structure and Reactivity-" published by Maruzen KK (1984).

It is considered that the Hammet $\sigma_p$ has additivity in this system and both of X and X' are not always required to be electron attracting groups. When one of X and X', i.e. X is an electron attracting group, therefore, the other substituent X' is not particularly limited, but can be any substituent having a sum of $\sigma_p$ of X and X' in the range of at least 0.45.

Specific examples of X and/or X', as an electron attractive group, are halogen atoms such as fluorine, chlorine and bromine atoms, —$CF_3$, —CN, —$NO_2$, —COR, —COOR, —$SO_2R$ and the like.

In the above described group, R is a hydrocarbon group containing 1 to 18 carbon atoms, preferably an optionally substituted alkyl group containing 1 to 18 carbon atoms, such as methyl, ethyl, propyl, butyl, pentyl, hexyl, octyl, decyl, dodecyl, tridecyl, tetradecyl, trifluoromethyl, chloromethyl, 2-chloroethyl, 2-bromoethyl, 2-cyanoethyl, 2-hydroxyethyl, 2-methoxyethyl, 2-ethoxyethyl, 3-hydroxypropyl, 2-methoxycarbonylethyl groups and the like; and optionally substituted alkenyl group containing 2 to 18 carbon atoms such as vinyl, ally, isopropenyl, butenyl, hexenyl, heptenyl, octenyl groups and the like; an optionally substituted aralkyl group containing 7 to 12 carbon atoms, such as benzyl, phenethyl, naphthylmethyl, 2-naphthylethyl, methoxybenzyl, ethoxybenzyl, methylbenzyl groups and the like; an optionally substituted cycloalkyl group containing 5 to 8 carbon atoms, such as cyclopentyl, cyclohexyl, cycloheptyl groups and the like; and an optionally substituted aryl group such as phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl groups and the like.

Other substituents of X and X' include any one capable of satisfying such a condition that the total of the Hammet substituent constants $\sigma_p$ is at least 0.45 as described above.

Preferred examples of the substituent are a hydrogen atom,

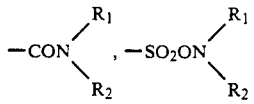

and the like

In these substituents, $R_1$ and $R_2$ represent, same or different, hydrogen atoms or hydrocarbon groups and in the case of hydrocarbon groups, $R_1$ and $R_2$ have the same meaning as R.

In General Formula ($I_0$), $R_0$ is a hydrogen atom or an alkyl group containing 1 to 6 carbon atoms, such as methyl, ethyl, propyl, butyl, pentyl or hexyl group.

Specific, but not limiting examples of the polymeric constituent containing the functional group represented by General Formula (I) will be illustrated below. In Examples (a-1) to (a-36). a represents —H or —$CH_3$.

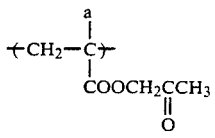

(a-1)

-continued
(a-2)
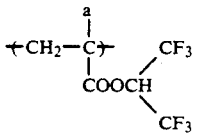
(a-3)
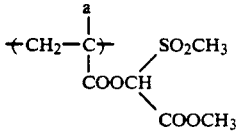
(a-4)
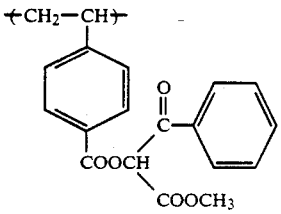
(a-5)
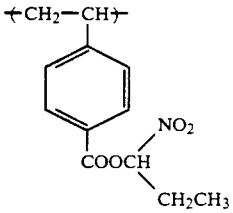
(a-6)
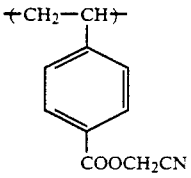
(a-7)
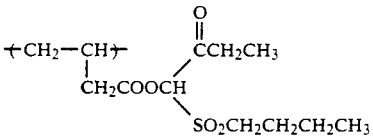
(a-8)
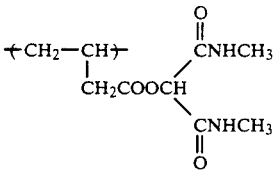
(a-9)
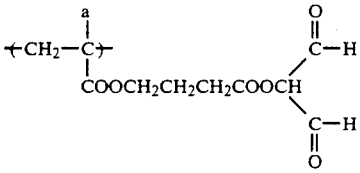
(a-10)
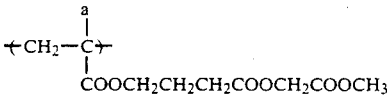
-continued
(a-11)
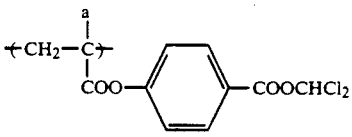
(a-12)
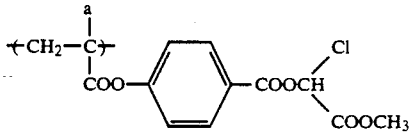
(a-13)
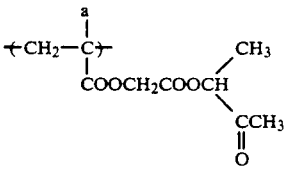
(a-14)
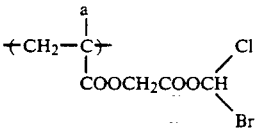
(a-15)
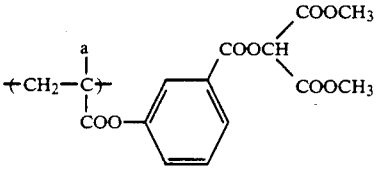
(a-16)
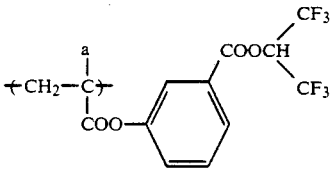
(a-17)
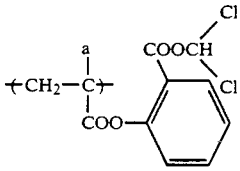
(a-18)
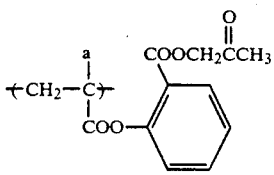
(a-19)
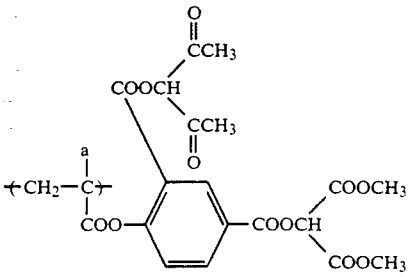

-continued
(a-20)
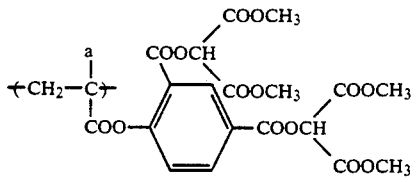
(a-21)
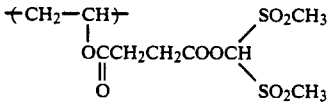
(a-22)
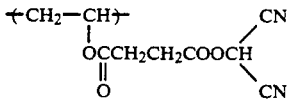
(a-23)
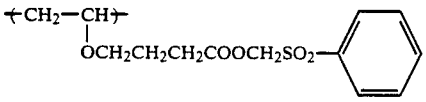
(a-24)
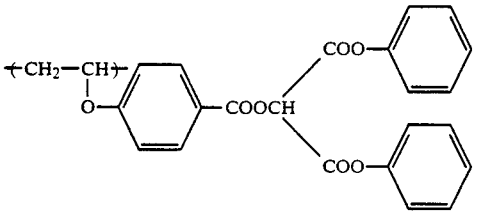
(a-25)
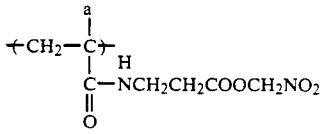
(a-26)
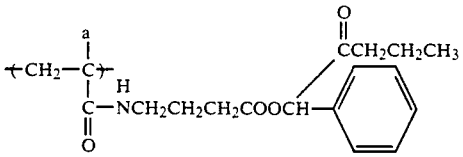
(a-27)
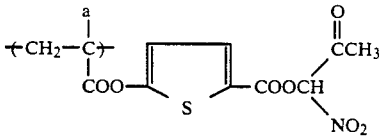
(a-28)
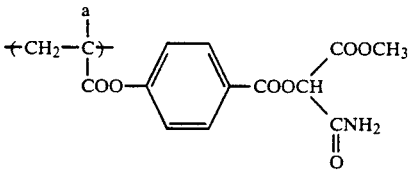
(a-29)
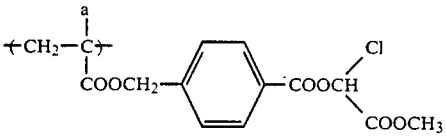
-continued
(a-30)
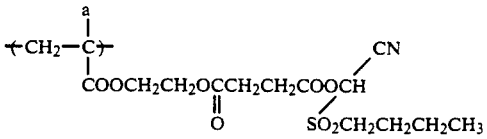
(a-31)
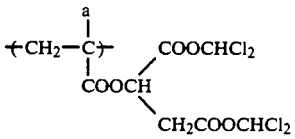
(a-32)
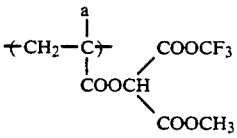
(a-33)
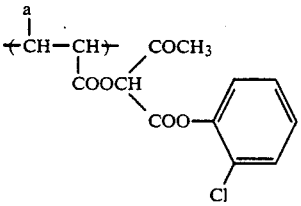
(a-34)
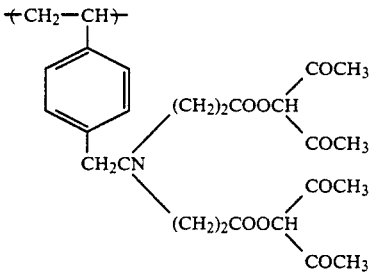
(a-35)
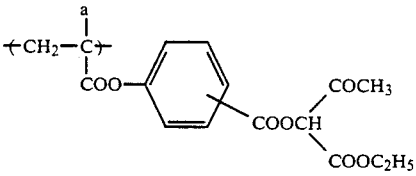
(a-36)
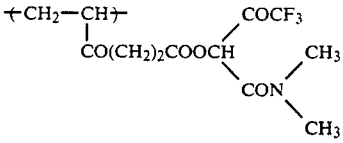
Specific, but not limiting examples of the functional group represented by General Formula (II) will be illustrated below. In Examples (b-1) to (b-28), $R_3$ represents $-C_mH_{2m+1}$ (m is an integer of 1 to 4).
(b-1)
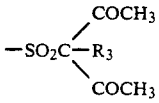
(b-2)
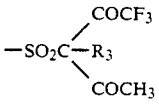

-continued
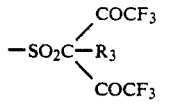
(b-3)
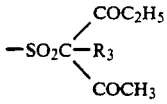
(b-4)
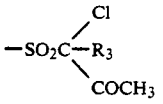
(b-5)
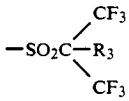
(b-6)
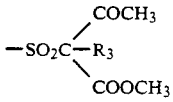
(b-7)
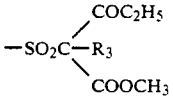
(b-8)
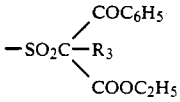
(b-9)
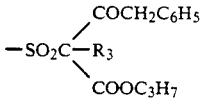
(b-10)
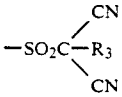
(b-11)
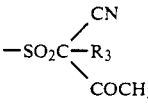
(b-12)
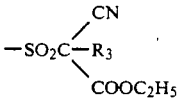
(b-13)
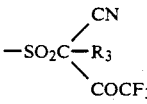
(b-14)
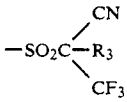
(b-15)
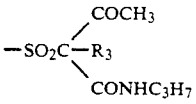
(b-16)
-continued
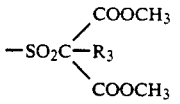
(b-17)
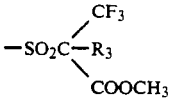
(b-18)
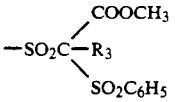
(b-19)
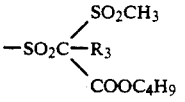
(b-20)
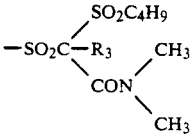
(b-21)
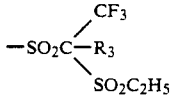
(b-22)
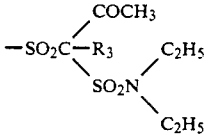
(b-23)
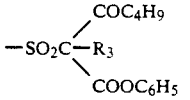
(b-24)
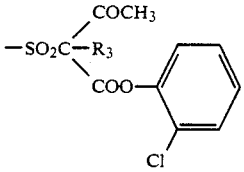
(b-25)
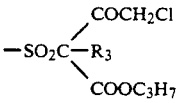
(b-26)
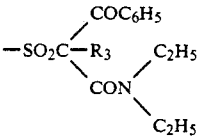
(b-27)
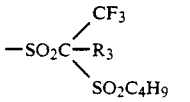
(b-28)
Specific, but not limiting examples of the copolymeric constituent containing the functional group represented by General Formula (II) are those represented by the forgoing General Formula (III).

Specific, but not limiting examples of the moiety represented by General Formula (III):

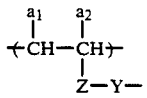

will be illustrated below. In Examples (c-1) to (c-17), b represents —H or —$CH_3$ and n represents 2 to 8.

(c-1)

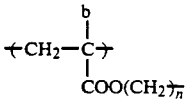

(c-2)

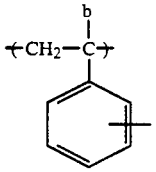

(c-3)

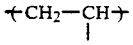

(c-4)

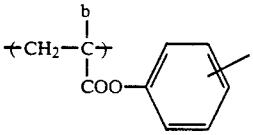

(c-5)

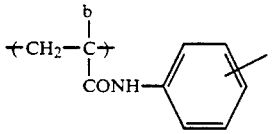

(c-6)

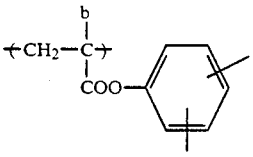

(c-7)

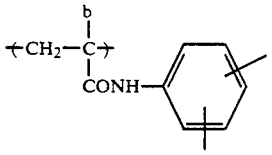

(c-8)

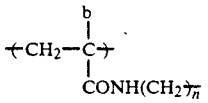

(c-9)

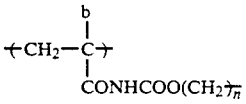

(c-10)

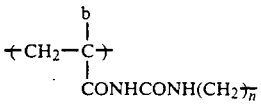

-continued (c-11)

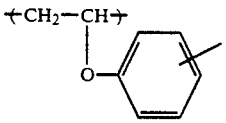

(c-12)

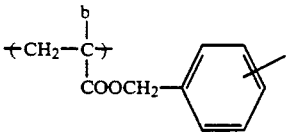

(c-13)

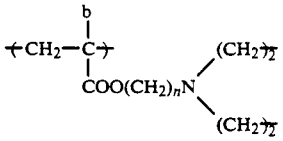

(c-14)

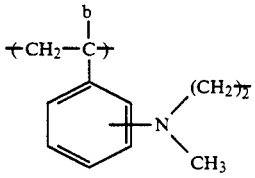

(c-15)

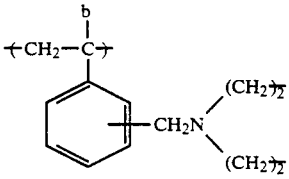

(c-16)

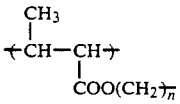

(c-17)

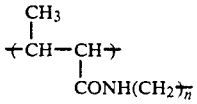

Resin [P] containing the polymeric component containing the functional group represented by General Formula ($I_0$) as described above can be synthesized by any of known methods, for example, by a method comprising subjecting to polymerization reaction a monomer containing the functional group represented by General Formula ($I_0$) and a polymerizable double bond group in the molecule (e.g. monomer corresponding to the recurring unit of General Formula (III)) and a method comprising reacting a low molecular compound containing the functional group represented by General Formula ($I_0$) with a high molecular compound containing a polymeric constituent containing a functional group reactive with the low molecular compound, which is called "polymer reaction".

The carboxylic acid ester-forming reaction in the above described synthesis by the monomer synthesis or polymer reaction is, for example, carried out by the method described in Nippon Kagaku Edition, "Shin-Jikken Kageku Koza", Vol. 14, page 1000, -Synthesis and Reaction of Organic Compounds- (1978), published by Maruzen KK.

The sulfonyl compound in the above described synthesis by the monomer synthesis or polymer reaction can readily be synthesized in known manner, for example, as mentioned in Nippon Kagaku Edition, "Shin-Jikken Kagaku Koza", Vol. 14, page 1761, -Synthesis and Reaction of Organic Compounds- (1978), published by Maruzen KK.

In Resin [P] of the present invention, the polymeric component containing the functional group represented by General Formula ($I_0$) is generally present in a proportion of 1 to 95% by weight, preferably 5 to 90% by weight based on the whole copolymer in a case where Resin [P] is of the copolymer. Preferably, this resin has a molecular weight of $10^3$ to $10^6$, particularly, $3\times10^3$ to $5\times10^5$.

Resin [P] of the present invention may be crosslinked, at least in part, in an electrophotographic lithographic printing plate precursor. As such a resin, there can be used a previously crosslinked resin during coating a light-sensitive layer-forming material in the plate-making step or a resin containing crosslinking functional groups causing a hardenable reaction by heat and/or light, which can be crosslinked in a process for producing a lithographic printing plate precursor (e.g. during drying). These resins can be used in combination.

When using, as a binder resin, such a resin that at least a part of the polymer is previously crosslinked (resin having a crosslinked structure in the polymer), it is preferably a resin which is hardly soluble or insoluble in acidic or alkaline solutions when the above described functional group (General Formula $I_0$) contained in the resin gives hydrophilic property through an oil-desensitization treatment. Specifically, the solubility of the resin in distilled water at 20° to 25° C. is preferably at most 90% by weight, more preferably at most 70% by weight.

Introduction of a crosslinked structure in a polymer can be carried out by known methods, that is, a method comprising subjecting a monomer containing the groups of General Formula ($I_0$) to polymerization reaction in the presence of a multifunctional monomer (monomer containing at least 2 polymerizable functional groups) or a multifunctional oligomer and a method comprising incorporating functional groups for effecting a crosslinking reaction in the polymer, then subjecting the polymer to polymer reaction with a compound containing the group of General Formula ($I_0$) and thus effecting the crosslinking.

Specifically, Resin [P] of the present invention can be prepared by a method comprising polymerizing a multifunctional monomer with a monomer containing at least one of the functional groups of General Formula ($I_0$) of the present invention, or a method comprising polymerizing the multifunctional monomer with a monomer containing a polar group such as —OH, —Cl, —Br, —I,

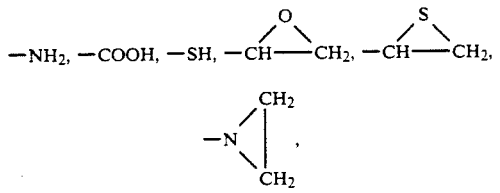

—N=C=O, —COCl, —$SO_2$Cl, etc., into which the functional group of General Formula ($I_0$) can be introduced, to prepare a copolymer and then introducing thereinto a low molecular compound containing the functional group of General Formula ($I_0$) by polymer reaction.

Examples of the polymerizable functional group are:

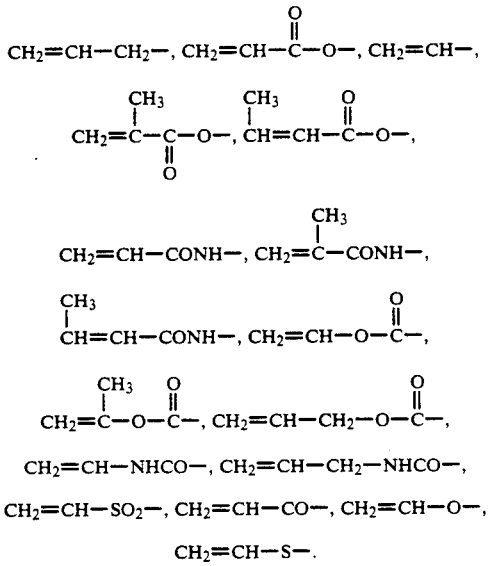

Any of monomers containing two or more same or different ones of these polymerizable functional groups can be used in the present invention.

Of these monomers, as the monomer having two or more same polymerizable functional groups, there can be used styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glycol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the multifunctional monomer or oligomer having different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, N-allylitaconamide, methacryloylpropionic acid allylamide and the like; and condensates of amino alcohols such as aminoethanol, 1-aminopropanol, 1-aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 mole %, preferably at most 5 mole % to all monomers, which is polymerized to form a previously crosslinked resin.

In the method comprising crosslinking a polymer containing functional groups for effecting a crosslinking reaction by polymer reaction, on the other hand, the functional group can be any group capable of causing a chemical reaction among the molecules to form chemical linkages. That is, the reaction mode of forming linkages among molecules by a condensation reaction or addition reaction, or crosslinkings by a polymerization reaction through heat and/or light can be utilized. Specifically, the functional groups include at least one combination selected from the group A consisting of functional groups containing dissociable hydrogen atoms, for example,

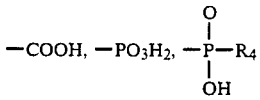

wherein $R_4$ represents an aliphatic group, preferably optionally substituted linear or branched alkyl group containing 1 to 12 carbon atoms, such as methyl, ethyl, propyl, chloromethyl, dichloromethyl, trichloromethyl, trifluoromethyl, butyl, hexyl, octyl, decyl, hydroxyethyl or 3-chloropropyl group, or $—OR_5$ wherein $R_5$ has the same meaning as $R_4$, —OH, —SH and $—NH.R_6$ wherein $R_6$ represents a hydrogen atom or an alkyl group containing 1 to 4 carbon atoms, such as methyl, ethyl, propyl or butyl group, and the group B consisting of

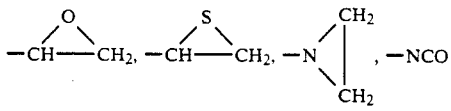

and —NCS and cyclic dicarboxylic acid anhydrides, or $—CONHCH_2OR_7$ wherein $R_7$ represents a hydrogen atom or an alkyl group containing 1 to 6 carbon atoms, such as methyl, ethyl, propyl, butyl or hexyl group, or a group of:

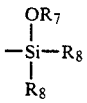

wherein $R_8$ is $—OR_7$ or an alkyl group containing 1 to 6 carbon atoms or polymerizable double bond groups.

Examples of the polymerizable double bond group include those of the foregoing polymerizable functional group.

Furthermore, there can be used functional groups and compounds described in, for example, Takeshi Endo "Rendering Precise Heat Setting Polymers (Netsu-kokasei Kobunshi no Seimitsuka)" published by C.M.C. KK, 1986, Yuji Harazaki "Latest Binder Technique Handbook (Saishin Binder Gijutsu Binran)" Section II-1, published by Sogogijutsu Center, 1985, Takayuki Otsu "Synthesis and Design of Acrylic Resins and Development of New Uses (Akuriru Jushi no Gosei.Sekkei to Shin-yoto Kaihatsu)" published by Chubu Keiei Kaihatsu Center Shuppanbu, 1985, Eizo Omori "Functional Acrylic Resins (Kinosei Akuriru-kei Jushi)" published by Technosystem, 1985, Hideo Inui and Gentaro Nagamatsu "Light-sensitive Polymers (Kankosei Kobunshi)" published by Kodansha, 1977, Takahiro Tsunoda "New Light-sensitive Resins (Shin-Kankosei Jushi)", published by Insatsu Gakkai Shuppanbu, 1981, G. E. Green and B. P. Star "R. J. Macro. Sci. Reas. Macro. Chem.", C 21 (2), 187–273 (1981–82) and C. G. Roffey "Photopolymerization of Surface Coatings" published by A. Wiley Interscience Pub., 1982.

These crosslinking functional groups can be incorporated in one copolymeric constituent with the functional groups represented by General Formula ($I_0$), or can be incorporated in another copolymeric constituent than a copolymeric constituent containing the functional groups represented by General Formula ($I_0$).

Examples of the monomer corresponding to the copolymer constituent containing these crosslinking functional groups include vinyl compounds containing the functional groups copolymerizable with the polymeric constituents of General Formula (III).

These vinyl compounds include those described in, for example, Kobunshi Gakkai "Polymer Data Handbook -Kisohen-", published by Baihukan, 1986, for example, acrylic acid, α and/or β-substituted acrylic acid such as α-acetoxy, α-acetoxymethyl, α-(2-aminomethyl), α-chloro, α-bromo, α-fluoro, α-tributylsilyl, α-cyano, β-chloro, β-bromo, α-chloro-β-methoxy and α,β-dichloro substituted ones, methacrylic acid, itaconic acid, itaconic acid semi-esters, itaconic acid semiamides, crotonic acid, 2-alkenylcarboxylic acids such as 2-pentenoic acid, 2-methyl-2-hexenoic acid, 2-octenoic acid, 4-methyl-2-hexenoic acid and 4-ethyl-2-octenoic acid, maleic acid, maleic acid semi-esters, maleic acid semi-amides, vinylbenzenecarboxylic acid, vinylbenzenesulfonic acid, vinylsulfonic acid, vinylphosphonic acid, semi-ester derivatives of vinyl groups or allyl groups of dicarboxylic acids and ester derivatives and amide derivatives of these carboxylic acids or sulfonic acids containing crosslinking functional groups in the substituents.

"The copolymeric constituent containing the crosslinking functional groups" is present in a proportion of 1–60 wt %, preferably 5–40 wt % to the binder resin.

As the crosslinking agent in the present invention, there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane triisocyanate, polymethylenepolyphenyl isocyanate, hexamethylene diisocyanate, isophorone diisocyanate, high molecular polyisocyanates; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; titanate coupling compounds such as tetrabutoxytitanate, tetrapropoxytitanate, isopropylstearoyltitanate and the like; aluminum coupling compounds such as aluminum butyrate, aluminum acetylacetate, aluminum oxide octate, aluminum tris(acetylacetate) and the like; polyepoxy group-containing compounds and epoxy resins, for example, as described in Hiroshi Kakiuchi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), and multifunctional polymerizable group-containing monomers such as vinyl methacrylate, allyl methacrylate, ethylene glycol diacrylate, polyethylene glycol diacrylate, divinyl succinate, divinyl adipate, diallyl succinate, 2-methylvinyl methacrylate, trimethylolpropane trimethacrylate, divinylbenzene, pentaerythritol polyacrylate and the like.

As described above, in the binder resin in the photoconductive layer of the present invention, the crosslinking reaction in the presence of a hardenable compound is preferably carried out with a combination capable of promoting chemical bonding among polymer chains. For example, the polymer reaction by combination of functional groups is carried out by the well-known method, as exemplified by combination of functional groups classified as Groups A and B in the following Table 1. The present invention is not limited thereto.

TABLE 1

| Group A | Group B |
|---|---|
| $-COOH$, $-PO_3H_2$<br>$-OH$, $-SH$<br>$-NH_2$<br>$-SO_2H$ | 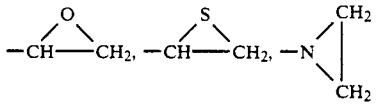 <br>$-COCl$, $-SO_2Cl$<br>cyclic acid anhydride<br>$-N=C=O$, $-N=C=S$<br> 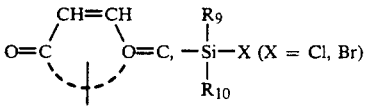 <br> 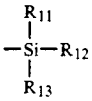 |

In Table 1, $R_9$ and $R_{10}$ are alkyl groups and $R_{11}$ to $R_{13}$ are alkyl or alkoxy groups, at least one of which is an alkoxy group.

In the present invention, a reaction promoter can if necessary be added to a binder resin in order to promote the crosslinking reaction in a photoconductive layer. In a case where the crosslinking reaction is carried out by a reaction system for forming chemical bonds among functional groups, for example, there are used, as the promoter, organic acids such as acetic acid, propionic acid, butyric acid, benzenesulfonic acid, p-toluenesulfonic acid and the like, phenols such as phenol, chlorophenol, nitrophenol, cyanophenol, bromophenol, naphthol, dichlorophenol and the like, organo metallic compounds such as acetylacetonatozirconium salt, acetylacetonezirconium salt, acetylacetonecobalt salt, dilauroyldibutoxytin and the like, dithiocarbamate compounds such as diethyldithiocarbamate, thiuram disulfide compounds such as tetramethylthiuram disulfide, carboxylic anhydrides such as phthalic anhydride, maleic anhydride, succinic anhydride, butylsuccinic anhydride, 3,3',4,4'-benzophenonetetracarboxylic acid anhydride, trimellitic anhydride and the like.

In another case where the crosslinking reaction is carried out by a polymerizable reaction system, there can be used polymerization initiators such as peroxides and azobis compounds.

The binder resin having a crosslinked structure in a photoconductive layer can be obtained, in a process for the production of the resin of the present invention, by employing the above described method for forming a crosslinked structure, or a method comprising using a resin containing crosslinking functional groups causing a hardening reaction by heat and/or light, as described above, with the functional groups represented by General Formula ($I_0$) and effecting the crosslinking during the step of forming the photoconductive layer or irradiating heat and/or light before the oil-desensitization processing. Ordinarily, it is preferable to effect the crosslinking by a heat-hardening treatment. This heat-hardening treatment can be carried out by rendering severe the drying conditions in the production of a photoreceptor according to the prior art, for example, at a temperature of 60° to 120° C. for 5 to 120 minutes. Joint use of the above described reaction promoter results in that this treatment can be carried out under milder conditions.

As a method of hardening the specified functional group in the resin of the present invention by irradiation, it is preferable to insert a step of irradiating by "chemically active light". "Chemically active light" used in the present invention includes visible rays, ultraviolet rays, far ultraviolet rays, electron beam, X-rays, γ-rays, α-rays and the like. Above all, ultraviolet rays is preferably used. More preferably, a mercury lamp or halogen lamp of a low voltage, high voltage or superhigh voltage, capable of emitting a light with a wavelength in the range of 310 nm to 500 nm, is used. This radiation treatment is ordinarily carried out for a period of time of 10 seconds to 10 minutes from a distance of 5 to 50 cm.

Resin [P] of the present invention contains functional groups capable of undergoing a crosslinking reaction with Resin B by heating or irradiating. As these functional groups, there can be used those similar to the following crosslinking functional groups contained in Resin B (heat and/or light-hardenable functional groups: sometimes referred to as hardenable functional groups). In the case of Resin [P] containing the hardenable functional groups, "the content of copolymeric constituents containing the hardenable functional groups" is preferably 1 to 20% by weight, more preferably 3 to 10% by weight in Resin [P].

In the present invention, incorporation of at least one functional group selected from the group consisting of the hardenable functional groups in Resin [P] is carried out by a method comprising introducing a low molecular, hardenable functional group-containing compound into a polymer containing the functional groups represented by General Formula ($I_0$) by polymer reaction, or a method comprising copolymerizing at least one monomer corresponding to the copolymeric component containing at least one of the hardenable functional groups with a monomer corresponding to the repeating unit represented by General Formula (III) (monomer synthesis).

The former polymer reaction can be carried out by any of known methods, for example, Nippon Kagakukai Edition, Shin-Jikken Kagakukoza, Vol. 14, "Synthesis and Reaction of Organic Compounds (I) to (V) (Yuki Kagobutsu no Gosei to Hanno)" published by Maruzen KK, 1978, and Yoshio Iwakura and Keisuke Kurita "Reactive Polymers (Hannosei Kobunshi)" published by Kohdansha (1977).

As a monomer corresponding to the copolymeric component containing the hardenable functionable group, used in the latter monomer synthesis method, there can be used vinyl compounds containing the hardenable functional groups, which are copolymerizable with the polymeric component containing the hydrophilic group-forming functional group in Resin A (e.g. compound corresponding to General Formula (III)), such as those exemplified above as the monomer corresponding to the copolymeric component containing the crosslinking functional groups.

Resin [B] used in the present invention will now be illustrated in detail. Resin [B] is a hardenable resin causing a crosslinking reaction by heat and/or light, preferably causing a crosslinking reaction with the functional group described above in Resin [P], and includes any of resins containing "heat and/or light-hardenable functional groups (sometimes referred to as hardenable functional groups in brief)" which will hereinafter be illustrated. As illustrated above, these hardenable functional groups may be contained in Resin [P].

As the light-hardenable functional group of the hardenable functional groups of the present invention, there can be used functional groups used in light-sensitive resins of the prior art as light-hardenable resins, for example, described in Hideo Inui and Gentaro Nagamatsu "Light-sensitive Polymers (Kankosei Kobunshi)" Kodansha KK, 1977, Takahiro Tsunoda "New Light-sensitive Resins (Shin-kankosei Jushi)" published by Insatsu Gakkai Shuppanbu, 1981, G. E. Green and B. P. Strark "J. Macro. Sci. Revs. Macro. Chem." C 21 (2), 187–273 (1981–82) and C. G. Rattey "Photopolymerization of Surface Coatings" published by A. Wiley Interscience Pub., 1982).

As the heat-hardenable functional group of the hardenable functional groups of the present invention, there can be used functional groups, for example, cited in the literatures described above to exemplify the polymerizable double bond groups.

Specifically, there are functional groups (Group A) each having dissociable hydrogen and functional groups (Group B) capable of chemically reacting and bonding with Group A, or polymerizable double bond groups, which will hereinafter be exemplified.

As the functional group (Group A) having dissociable hydrogen atom, for example, there are given —OH group, —SH group, $—NH_2$ group, $—NHR_{14}$ group wherein $R_{14}$ represents a hydrocarbon group, e.g., optionally substituted alkyl group containing 1 to 10 carbon atoms, such as methyl, ethyl, propyl, butyl, hexyl, octyl, decyl, 2-chloroethyl, 2-methoxyethyl, 2-cyanoethyl, etc., optionally substituted cycloalkyl group containing 4 to 8 carbon atoms, such as cycloheptyl, cyclohexyl, etc., optionally substituted aralkyl group containing 7 to 12 carbon atoms, such as benzyl, phenethyl, 3-phenylpropyl, chlorobenzyl, methylbenzyl, methoxybenzyl group, etc., and optionally substituted aryl group such as phenyl, tolyl, xylyl, chlorophenyl, bromophenyl, methoxyphenyl, naphthyl group, etc., —COOH group, $—PO_3H_2$ group and the like.

As the functional group (Group B) capable of bonding with the functional group having dissociable hydrogen, for example, there are given groups of

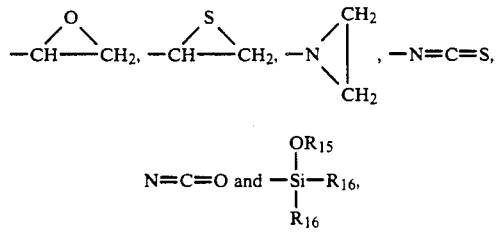

wherein $R_{15}$ represents a hydrogen atom or an alkyl group having 1 to 8 carbon atoms, such as methyl, ethyl, propyl, butyl, hexyl, octyl group, etc., and $R_{16}$ is $—OR_{15}$ having the same contents as described above or an alkyl group containing 1 to 4 carbon atoms, such as methyl, ethyl, propyl or butyl group. The isocyanate group (—N=C=O) can be a blocked isocyanate group corresponding to reaction products with active hydrogen-containing compounds such as phenol compounds, —NH— containing cyclic compounds, active methylene compounds, etc., as well known in the art.

As the self-crosslinking functional group, there are given the following groups:

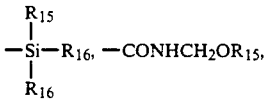

(wherein $R_{15}$ has the same meaning as described above) and

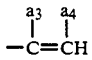

wherein $a_3$ and $a_4$ are respectively hydrogen atoms, halogen atoms such as chlorine, bromine atoms, etc., and alkyl groups containing 1 to 4 carbon atoms, such as methyl, ethyl groups, etc.

The crosslinking structure is formed by chemical bonds among these functional groups. For example, at least one combination is selected from Group A and Group B in the following Table 2.

TABLE 2

| Functional Groups (Group A) (functional groups having dissociable hydrogen atoms) | Functional Groups (Group B) (functional groups capable of chemically reacting and bonding with Group A) |
|---|---|
| —OH, —SH, $—NH_2$ or —NHR' wherein R' is a hydrocarbon group, —COOH, $—PO_3H$ | 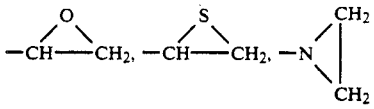 |
| | —N=C=O, —N=C=S, cyclic dicarboxylic acid anhydrides, blocked isocyanate groups such as |
| | 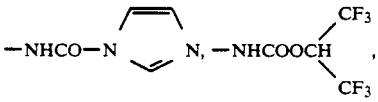 |
| | 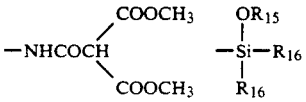 |

The crosslinking reaction can be carried out by a polymerizable reaction using polymerizable double bond groups, exemplified above as the polymerizable functional groups.

As the monomer containing "the heat and/or light hardenable functional group" according to the present invention, there can be used any of monomers containing hardenable functional groups in the substituents, which are copolymerizable with the monomer corresponding to the foregoing "copolymeric component represented by General Formula (III)".

Examples of the copolymeric component containing the "heat and/or light-hardenable functional group" are the following repeating units (d-1) to (d-26):

(d-1)

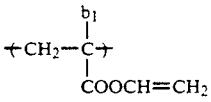

$b_1$: —H, $CH_3$ ($b_1$: same in the following)

(d-2)

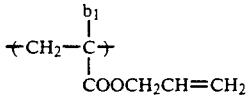

(d-3)

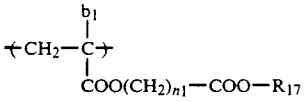

$R_{17}$: $—CH=CH_2$, $—CH_2CH=CH_2$
($R_{17}$: same in the following)
$n_1$: integer of 1 ~ 11

(d-4)

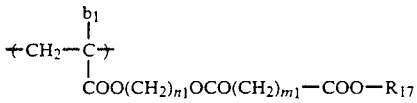

$n_1$, $m_1$: integer of 1 ~ 11

-continued (d-5)

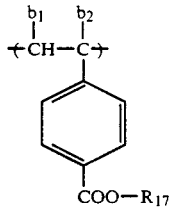

$b_2$: H, $CH_3$ ($b_2$: same in the following)

(d-6)

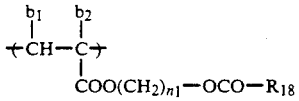

$R_{18}$: $—CH=CH_2$, $—C(CH_3)=CH_2$, $—CH=CH(CH_3)$ ($R_{18}$: same in the following)
$n_1$: integer of 1 ~ 11

(d-7)

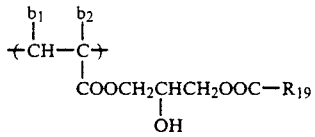

$R_{19}$: $—CH=CH_2$, $CH_2CH=CH_2$, $—C(CH_3)=CH_2$,

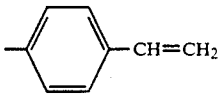

($R_{19}$: same in the following)

(d-8)

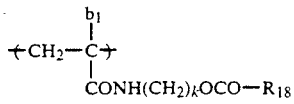

k: integer of 1 ~ 10

-continued
(d-9)
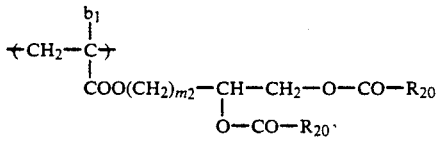
$R_{20}$: $-CH=CH_2$, $-C(CH_3)=CH_2$,
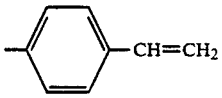
($R_{20}$: same in the following)
$m_2$: integer of 1~4
(d-10)
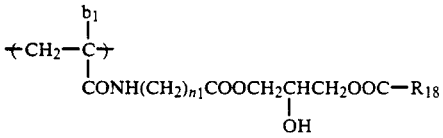
$n_1$: integer of 1~11
(d-11)
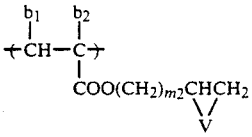
$m_2$: integer of 1~4
V: —S—, —O—
(d-12)
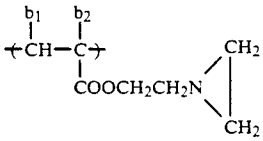
(d-13)
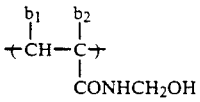
(d-14)
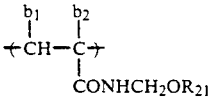
$R_{21}$: $C_1$~$C_4$ alkyl group
(d-15)
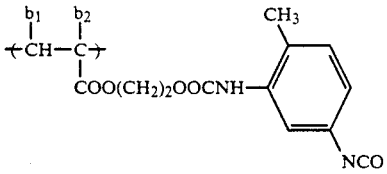
(d-16)
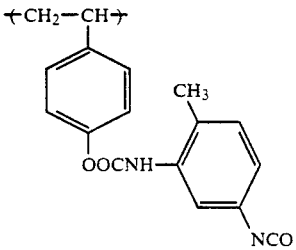
-continued
(d-17)
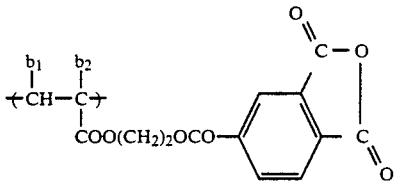
(d-18)
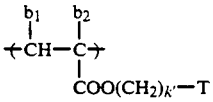
T: —OH, $-NH_2$
k': integer of 2~11
(d-19)
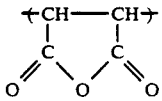
(d-20)
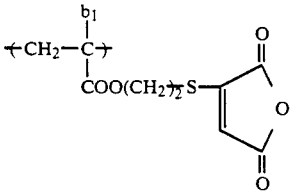
(d-21)
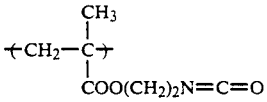
(d-22)
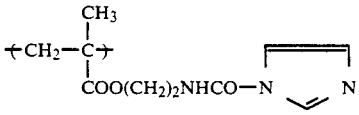
(d-23)
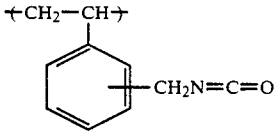
(d-24)
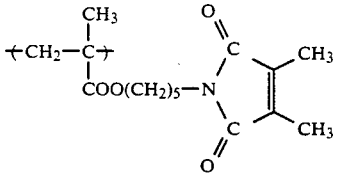
(d-25)
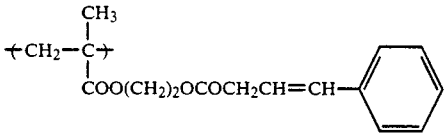
(d-26)
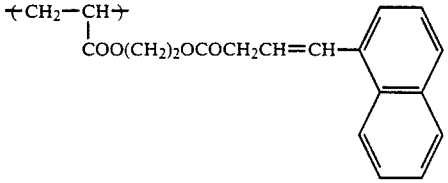

-continued

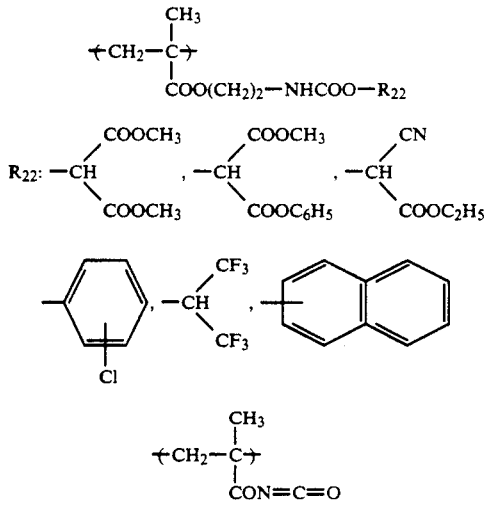

(d-27)

(d-28)

More specifically, there are given (meth)acrylic copolymers containing at least 30% by weight, based on the total amount of the copolymer, of a monomer represented by the following General Formula (IV) as a copolymeric constituent, exemplified as Resin B:

General Formula (IV)

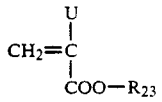

wherein U is a hydrogen atom, a halogen atom such as chlorine or bromine atom, cyano group, an alkyl group containing 1 to 4 carbon atoms, and $R_{23}$ is an alkyl group containing 1 to 18 carbon atoms, which can be substituted, such as methyl, ethyl, propyl, butyl, pentyl, hexyl, octyl, decyl, dodecyl, tridecyl, tetradecyl, 2-methoxyethyl or 2-ethoxyethyl group, an alkenyl group containing 2 to 18 carbon atoms, which can be substituted, such as vinyl, allyl, isopropenyl, butenyl, hexenyl, heptenyl or octenyl group, an aralkyl group containing 7 to 12 carbon atoms, which can be substituted, such as benzyl, phenethyl, methoxybenzyl, ethoxybenzyl or methylbenzyl group, a cycloalkyl group containing 5 to 8 carbon atoms, which can be substituted, such as cyclopentyl, cyclohexyl or cycloheptyl group, or an aryl group, which can be substituted, such as phenyl, tolyl, xylyl, mesityl, naphthyl, methoxyphenyl, ethoxyphenyl, chlorophenyl or dichlorophenyl group.

In Resin [B], the content of "copolymeric components containing crosslinking (hardenable) functional groups" is preferably 0.5 to 30 weight %.

The weight average molecular weight of Resin [B] is preferably $1\times10^3$ to $1\times10^6$, more preferably $5\times10^3$ to $5\times10^5$.

The ratio of Resin [P] and Resin [B], used in the present invention, depending on the kind, grain diameter and surface state of inorganic photoconductive materials used therewith, is generally 5–95 of the former to 95–5 of the latter (by weight), preferably 50–90 to 50–10.

The binder resin of the present invention may further contain a crosslinking agent in addition to Resin [P], or Resin [P]+Resin [B].

As the crosslinking agent in the present invention, there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane triisocyanate, polymethylenepolyphenyl isocyanate, hexamethylene diisocyanate, isophorone diisocyanate, high molecular polyisocyanates; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Hiroshi Kakiuchi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea Melamine Jushi)" published by Nikkan Kogyo Shinbunsha (1969); and poly(meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

The quantity of the crosslinking agent used in the present invention is generally 0.5 to 30% by weight, preferably 1 to 20% by weight based on the resin used in the surface layer.

In the present invention, a reaction promoter can optionally be added to Resin [P] or Resin [B] so as to promote the crosslinking reaction in the photoconductive layer.

In a case where the crosslinking reaction is carried out by a reaction system for forming chemical bonds among functional groups, for example, organic acids such as acetic acid, propionic acid, butyric acid, benzenesulfonic acid, p-toluenesulfonic acid, phenol, chlorophenol, cresol, cyanophenol, etc. and organo metallic compounds such as tetraalcoholate titanate, trialcoholate aluminate, dialkyldicarbonate tin, acetylacetonezirconium salt, etc. are used as the promoter, while in another case where the crosslinking reaction is carried out by a polymerizable reaction system, there are used polymerization initiators such as peroxides and azobis compounds, the latter being preferable, and multifunctional polymerizable group-containing monomers such as vinyl methacrylate, allyl methacrylate, ethylene glycol diacrylate, polyethylene glycol diacrylate, divinyl succinate, divinyl adipate, diallyl succinate, 2-methylvinyl methacrylate, divinylbenzene and the like.

In the present invention, other resins can jointly be used in addition to Resins [P] and [B] of the present invention, for example, silicone resins, alkyd resins, polybutylal resins, polyolefin resins, ethylenevinyl acetate resins, styrene resins, styrene-butadiene resins, acrylate-butadiene resins, vinyl alkanate resins, polyester resins, acrylic resins and the like. For example, these resins are described in Takaharu Kurita and Jiro Ishiwataru "High Molecular Materials (Kobunshi)" 17, 278 (1968) and Harumi Miyamoto and Hidehiko Takei "Imaging" No. 8, page 9 (1973).

The resin of the present invention and the known resin can be mixed in optional proportions, but it is preferable to adjust the mixing proportion so that the content of the functional group be 1 to 95% by weight, preferably 5 to 70% by weight based on the whole resin, since if less than 1% by weight, the resulting lithographic printing plate precursor meets with a problem that the hydrophilic property obtained by the oil-desensitization treatment with an oil-desensitizing solution or dampening water is not sufficient to result in background stains during printing, while if more than 95% by weight, the film strength of the photoconductive layer during printing is lowered, resulting in deterioration of the durability.

The binder resin of the present invention is subjected to crosslinking after coating a light-sensitive layer forming composition. The crosslinking is preferably carried out, for example, by maintaining the drying conditions at a high temperature and/or for a long period of time, or by further subjecting to a heat treatment after drying the coating solvent, for example, at 60° to 120° C. for 5 to 120 minutes.

When using a light-crosslinking resin, the crosslinking is carried out by irradiating electron ray, X-rays, ultraviolet rays or plasma during, before or after drying and the reaction can further be promoted by the above described heating treatment during or after drying. The use of the above described reaction promoter results in a milder condition.

Resin [P] of the present invention has such an action that hydrophilic groups appear by an oil-desensitizing treatment to render non-image areas more hydrophilic.

Furthermore, in the precursor of the present invention, the binder resin having a crosslinked structure at least in a part of the polymer is capable of preventing the hydrophilic group-containing resin formed by an oil-desensitization processing from being water-soluble and dissolved out of the non-image area, while maintaining the hydrophilic property, that is, has durability.

Thus, the hydrophilic property of a non-image area can further be enhanced by hydrophilic groups formed in the resin and the durability is improved. Even if printing conditions become severer, for example, a printing machine is large-sized or printing pressure is fluctuated, a large number of prints with a clear image quality and free from background stains can be obtained.

The photoconductive layer of the present invention contains at least a photoconductive inorganic compound in addition to the above described binder resins [P] and [B].

As the photoconductive inorganic compound for the present invention, those known in the art can be used and considering the environmental pollution, it is preferable to use zinc oxide and titanium oxide, more preferably zinc oxide. In the lithographic printing precursor of the present invention, the above described binder resin is generally used in a proportion of 10 to 60 (10 to 100) parts by weight, preferably 15 to 40 (15 to 50) parts by weight to 100 parts by weight of the photoconductive zinc oxide.

When an oil-desensitizing processing (which will hereinafter be illustrated in detail) of a photoconductive compound is jointly used in the oil-desensitizing processing of the light-sensitive material of the present invention, the content of the functional group represented by General Formula ($I_0$) in Resin [P] containing the functional group represented by General Formula ($I_0$) is 1 to 80 weight %, preferably 5 to 70 weight %. On the other hand, when the oil-desensitizing is carried out with only the binder resin of the present invention, the content of the functional group of General Formula ($I_0$) is 50 to 95 weight %, preferably 60 to 90 weight %.

As the photoconductive zinc oxide of the present invention, any known compound can be used, for example, not only the so-called zinc oxide, but also acid-treated zinc oxide.

In the present invention, if necessary, various coloring matters or dyes can be used as a spectro sensitizer, illustrative of which are carbonium dyes, diphenylmethane dyes, triphenylmethane dyes, xanthene dyes, phthalein dyes, polymethine dyes such as oxonol dyes, merocyanine dyes, cyanine dyes, rhodacyanine dyes, styryl dyes, etc. and phthalocyanine dyes which can contain metals, as described in Harumi Miyamoto and Hidehiko Takei "Imaging" No. 8, page 12 (1973), C. Y. Young et al. "RCA Review" 15, 469 (1954), Kohei Kiyota et al. "Denki Tsushin Gakkai Ronbunshi" J63-C (No. 2), 97 (1980), Yuji Harasaki et al. "Kogyo Kagaku Zasshi" 66, 78 and 188 (1963) and Tadaaki Tani "Nippon Shashin Gakkaishi" 35, 208 (1972).

For example, those using carbonium dyes, triphenylmethane dyes, xanthene dyes or phthalein dyes are described in Japanese Patent Publication No. 452/1976, Japanese Patent Laid-Open Publication Nos. 90334/1975, 14227/1975, 39130/1978, 82353/1978 and 16456/1982 and U.S. Pat. Nos. 3,052,540 and 4,054,450.

As the polymethine dyes such as oxonol dyes, merocyanine dyes, cyanine dyes and rhodacyanine dyes, there can be used dyes described in F. M. Hammer "The Cyanine Dyes and Related Compounds" and specifically dyes described in U.S. Pat. Nos. 3,047,384, 3,110,591, 3,121,008, 3,125,447, 3,128,179, 3,132,942 and 3,622,317; British Patent Nos. 1,226,892, 1,309,274 and 1,405,898; and Japanese Patent Publication Nos. 814/1973 and 18892/1980.

The polymethine dyes capable of spectrally sensitizing near infrared radiations to infrared radiations with longer wavelengths of at least 700 nm are described in Japanese Patent Publication No. 41061/1976; Japanese Patent Laid-Open Publication Nos. 840/1972, 44180/1972, 5034/1974, 45122/1974, 46245/1982, 35141/1981, 157254/1982, 26044/1986 and 27551/1986; U.S. Pat. Nos. 3,619,154 and 4,175,956; and "Research Disclosure" 216, pages 117–118 (1982).

The photoreceptor of the present invention is excellent in that its performance is hardly fluctuated even if it is used jointly with various sensitizing dyes. Furthermore, various additives for electrophotographic light-sensitive layers, such as chemical sensitizers, well known in the art can jointly be used as occasion demands, for example, electron accepting compounds such as benzoquinone, chloranil, acid anhydrides, organic carboxylic acids and the like, described in the foregoing "Imaging" No. 8, page 12 (1973) and polyarylalkane compounds, hindered phenol compounds, p-phenylenediamine compounds and the like, described in Hiroshi Komon et al. "Latest Development and Practical Use of Photoconductive Materials and Light-Sensitive Materials (Saikin no Kododenzairyo to Kankotai no Kaihatsu to Jitsuyoka)" Sections 4 to 6, published by Nippon Kagaku Joho Shuppanbu (1986).

The amounts of these additives are not particularly limited, but are generally 0.001 to 2.0 parts by weight based on 100 parts by weight of the photoconductive zinc oxide.

The thickness of the photoconductive layer is generally 1 to 100 μm, preferably 10 to 50 μm.

When in a photoreceptor of laminate type consisting of a charge generating layer and charge transporting layer, a photoconductive layer is used as the charge producing layer, the thickness of the charge producing layer is generally 0.01 to 1 μm, preferably 0.05 to 0.5 μm.

The photoconductive layer of the present invention can be provided on a support as well known in the art. Generally, a support for an electrophotographic light-sensitive layer is preferably electroconductive and as the electroconductive support, there can be used, as known in the art, substrates such as metals, papers, plastic sheets, etc. which are rendered electroconductive by impregnating low resistance materials therein, substrates whose back surface, opposite to the surface to be provided with a light-sensitive layer, is made electroconductive, which is further coated with at least one layer for the purpose of preventing it from curling; the above described support provided with, on the surface thereof, a water proof adhesive layer; the above described support optionally provided with, on the surface layer, one or more pre-coat layer; and papers laminated with plastics which are made electroconductive, for example, by vapor deposition of Al or the like thereon. Examples of the substrates or materials which are electroconductive or rendered electroconductive are described in Yukio Sakamoto "Electrophotography (Denshi Shashin)" 14 (No. 1), pages 2 to 11 (1975), Hiroyuki Moriga "Introduction to Chemistry of Special Papers (Nyumon Tokushushi no Kagaku)" Kobunshi Kankokai (1975), M. F. Hoover "J. Macromol. Sci. Chem." A-4 (6), pp. 1327-1417 (1970), etc.

Production of a lithographic printing plate using the electrophotographic lithographic printing plate precursor according to the present invention can be carried out in known manner by forming a copying image thereon and then subjecting the non-image area to an oil-desensitization processing according to the present invention, in which both of an oil-desensitization reaction of zinc oxide (hereinafter referred to as Reaction A) and oil-desensitization reaction of the resin (hereinafter referred to as Reaction B) proceed. The oil-desensitization processing can be carried out by any of (a) a method comprising effecting the Reaction A processing and thereafter the Reaction B processing, (b) a method comprising effecting the Reaction B processing and thereafter the Reaction A processing and (c) a method comprising effecting simultaneously the Reactions A and B processings.

In the method for the oil-desensitization of zinc oxide, there can be used any of known processing solutions, for example, containing, as a predominant component, ferrocyanide compounds as described in Japanese Patent Publication Nos. 7334/1965, 33683/1970, 21244/1971, 9045/1969, 32681/1972 and 9315/1980, and Japanese Patent Laid-Open Publication Nos. 239158/1987, 292492/1987, 99993/1988, 99994/1988, 107889/1982 and 101102/1977, phytic acid compounds as described in Japanese Patent Publication Nos. 28408/1968 and 24609/1970, and Japanese Patent Laid-Open Publication Nos. 103501/1976, 10003/1979, 83805/1978, 83806/1978, 127002/1978, 44901/1979, 2189/1981, 2796/1982, 20394/1982 and 20729/1984, metal chelate-forming water-soluble polymers as described in Japanese Patent Publication Nos. 9665/1963, 22263/1964, 763/1965, 28404/1968 and 29642/1972, and Japanese Patent Laid-Open Publication Nos. 126302/1977, 134501/1977, 49506/1978, 59502/1978 and 104302/1978, metal complex compounds as described in Japanese Patent Publication Nos. 15313/1980 and 41924/1979 and Japanese Patent Laid-Open Publication No. 104301/1978, and inorganic acid- and organic acid compounds as described in Japanese Patent Publication Nos. 13702/1964, 10308/1965 and 26124/1971 and Japanese Patent Laid-Open Publication Nos. 118501/1976 and 111695/1981.

On the other hand, the oil-desensitization (i.e. giving hydrophilic property) of the binder resin [P] of the present invention, containing the functional group represented by General Formula ($I_0$), can be accomplished by processing with a solution containing a compound having hydrophilic groups capable of readily undergoing nucleophilic reaction with the functional group in the resin in water or a water-soluble organic solvent.

The hydrophilic compound causing a nucleophilic substitution reaction with the functional group represented by General Formula ($I_0$) includes a hydrophilic compound containing a substituent having a nucleophilic constant n of at least 5.5 (Cf. R. G. Pearson, H. Sobel and J. Songstad "J. Amer. Chem. Soc." 90, 319 (1968)) and being dissolved in distilled water in a proportion of at least 1 part by weight to 100 parts by weight of distilled water, illustrative of which are hydrazines, hydroxylamine, sulfites such as ammonium, sodium, potassium and zinc sulfites, thiosulfates, mercapto compounds each containing at least one polar group selected from the group consisting of hydroxyl, carboxyl, sulfo, phosphono and amino groups in the molecules, hydrazide compounds, sulfinic acid compounds, primary amine compounds and secondary amine compounds.

Examples of the mercapto compound are 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenedicarboxylic acid, 2-mercaptoethanesulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, 2-methyl-2-mercapto-1-aminoacetic acid and the like.

Examples of the sulfinic acid are 2-hydroxyethylsulfinic acid, 3-hydroxypropanesulfinic acid, 4-hydroxybutanesulfinic acid, carboxybenzenesulfinic acid, dicarboxybenzenesulfinic acid and the like.

Examples of the hydrazide compound are 2-hydrazinoethanesulfonic acid, 4-hydrazinobutanesulfonic acid, hydrazinobenzenesulfonic acid, hydrazinobenzenedisulfonic acid, hydrazinobenzoic acid, hydrazinobenzenedicarboxylic acid and the like.

Examples of the primary or secondary amine compound are N-(2-hydroxyethyl)amine, N,N-di(2-hydroxyethyl)amine, N,N-di(2-hydroxyethyl)ethylenediamine, tri(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2-hydroxyethylmorpholine, 2-carboxyethylmorpholine, 3-carboxypiperidine and the like.

These nucleophilic compounds are used in such a manner that each of them is contained in the foregoing oil-desensitization processing solution of the foregoing photoconductor (the foregoing method (c)) or in the foregoing processing solution of the binder resin (the foregoing method (a) or (b)).

The quantity of the nucleophilic compound in such a processing solution is generally 0.1 to 10 mol/l, preferably 0.5 to 5 mol/l. The processing conditions are a temperature of 15° to 60° C. and a period of time of 10 seconds to 5 minutes.

In addition to the above described nucleophilic compound and pH regulating agent, the processing solution may contain other compounds, for example, water-soluble organic solvents, individually or in combination, in a proportion of 1 to 50 parts by weight to 100 parts by weight of water, examples of which are alcohols such as methanol, ethanol, propanol, propargyl alcohol, benzyl alcohol, phenethyl alcohol, etc., ketones such as acetone, methyl ethyl ketone, acetophenone, etc., ethers such as dioxane, trioxane tetrahydrofuran, ethylene glycol, propylene glycol, ethylene glycol monomethyl ether, propylene glycol monomethyl ether, tetrahydropyran, etc., amides such as dimethylformamide, dimethylacetamide, etc., esters such as methyl acetate, ethyl acetate, ethyl formate, etc.

Furthermore, a surfactant can be incorporated in the processing solution in a proportion of 0.1 to 20 parts by weight to 100 parts by weight of water, illustrative of which are anionic, cationic and nonionic surfactants well known in the art, for example, described in Hiroshi Horiguchi "New Surfactants (ShinKaimen Kasseizai)" published by Sankyo Shuppan KK, 1975, Ryohei Oda and Kazuhiro Teramura "Synthesize of Surfactants and Applications Thereof (Kaimen Kasseizai no Gosei to sono Oyo)" published by Maki Shoten, 1980.

The scope of the present invention should not be construed to be limited to the above described and specified compounds.

The present invention will now be illustrated in greater detail by way of example, but it should be understood that the present invention is not limited thereto.

EXAMPLES

Synthetic Example 1 of Resin [P]: Resin [P]-1

A mixed solution of 63.5 g of benzyl methacrylate, 35 g of a monomer (M-1) having the following structure, 1.5 g of acrylic acid and 200 g of toluene was heated at a temperature of 75° C. under a nitrogen stream. While stirring, 1.0 g of azobis(isobutyronitrile) (hereinafter referred to as A.I.B.N.) was added thereto, followed by reacting for 4 hours, and 0.4 g of A.I.B.N. was further added, followed by reacting for 3 hours, The thus resulting polymer [P-1] had a weight average molecular weight ($\overline{M}w$) of $4.3\times10^4$.

Monomer M-1

-continued

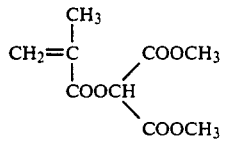

Resin [P-1]

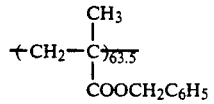

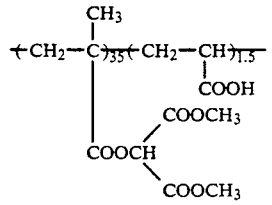

Synthetic Example 2 of Resin [P]: Resin [P-2]

A mixed solution of 52 g of phenyl methacrylate, 10 g of 2-hydroxyethyl methacrylate, 30 g of a monomer (M-2) having the following structure, 2.0 g of acrylic acid and 200 g of toluene was heated at a temperature of 70° C. under nitrogen stream. While stirring, 1.5 g of A.I.B.N. was added thereto, followed by reacting for 5 hours and 0.5 g of A.I.B.N. was further added, followed by reacting for 3 hours. The thus resulting polymer [P-2] had a ($\overline{M}w$) of $3.5\times10^4$.

Monomer (M-2)

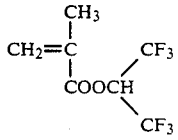

Resin [P-2]

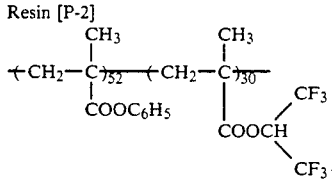

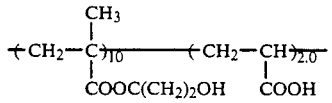

Synthetic Example 3 of Resin [P]: Resin [P-3]

A mixed solution of 18 g of ethyl methacrylate, 80 g of a monomer (M-3) having the following structure, 2.0 g of divinylbenzene and 200 g of toluene was heated at a temperature of 70° C. under a nitrogen stream, to which 1.5 g of azobis(isovaleronitrile) (referred to as A.I.V.N.) was then added while stirring, followed by reacting for 4 hours. 0.5 g of A.I.V.N. was further added thereto and reacted for 4 hours.

The resulting polymer [P-3] had a weight average molecular weight of $1.5\times10^5$.

Monomer (M-3)

-continued

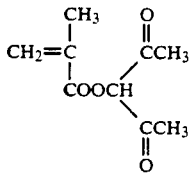

Resin [P-3]

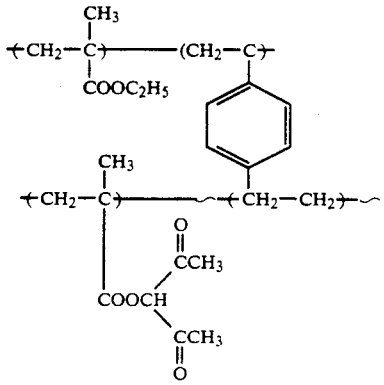

Synthetic Example 4 of Resin [P]: Resin [P-4]

A mixed solution of 90 g of a monomer (M-4) having the following structure, 10 g of glycidyl methacrylate, and 200 g of toluene was heated at a temperature of 70° C. under a nitrogen stream, to which 1.5 g of A.I.V.N. was then added while stirring, followed by reacting for 4 hours. 0.5 g of A.I.V.N. was further added thereto and reacted for 3 hours.

The resulting polymer [P-4] had a weight average molecular weight of $6.8\times10^4$.

Monomer (M-4)

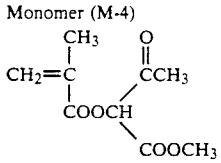

Resin [P-4]

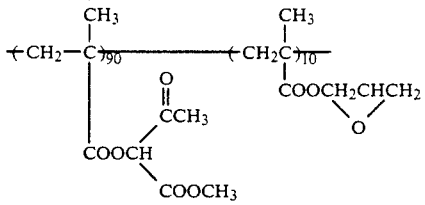

Synthetic Example 5 of Resin [P]: Resin [P-5]

A mixed solution of 90 g of Monomer (M-1), 10 g of glycidyl methacrylate and 200 g of toluene was heated at a temperature of 70° C. under a nitrogen stream, to which 1.0 g of A.I.B.N. was then added while stirring, followed by reacting for 4 hours. 0.4 g of A.I.B.N. was further added thereto and reacted for 3 hours.

The resulting polymer [P-5] had a weight average molecular weight of $6.5\times10^4$.

Resin [P-5]

-continued

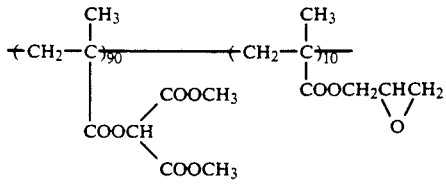

Synthetic Example 6 of Resin [P]: Resin [P-6]

A mixed solution of 89 g of Monomer (M-2), 5 g of glycidyl methacrylate, 5 g of 2-hydroxyethyl methacrylate, 1 g of acrylic acid and 200 g of toluene was heated at a temperature of 70° C. under a nitrogen stream, to which 1.5 g of A.I.B.N. was then added while stirring, followed by reacting for 5 hours. 0.5 g of A.I.B.N. was further added thereto and reacted for 3 hours.

The resulting polymer [P-6] had a weight average molecular weight of $5.3\times10^4$.

Resin [P-6]

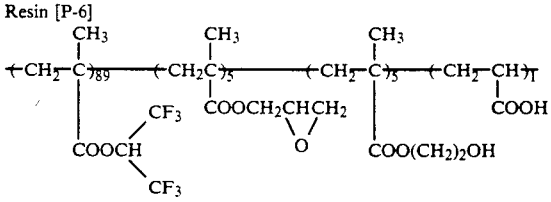

Synthetic Example 7 of Resin [P]: Resin [P-7]

A mixed solution of 70 g of 2-hydroxyethyl methacrylate, 80 g of Monomer (M-3), 2.0 g of divinylbenzene and 200 g of toluene was heated at a temperature of 70° C. under a nitrogen stream, to which 1.5 g of A.I.V.N. was then added while stirring, followed by reacting for 4 hours. 0.5 g of A.I.V.N. was further added thereto and reacted for 4 hours.

The resulting polymer [P-7] had a weight average molecular weight of $1.5\times10^5$.

Resin [P-7]

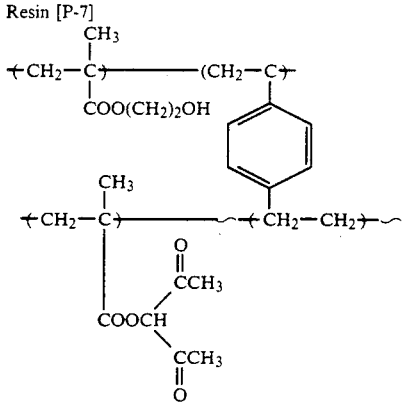

Synthetic Example 8 of Resin [P]: Resin [P-8]

A mixed solution of 90 g of Monomer (M-4), 10 g of triethoxypropyl methacrylate, and 200 g of toluene was heated at a temperature of 65° C. under a nitrogen stream, to which 1.0 g of A.I.V.N. was then added while stirring, followed by reacting for 4 hours. 0.5 g of A.I.V.N. was further added thereto and reacted for 3 hours.

The resulting polymer [P-8] had a weight average molecular weight of $7.2\times10^4$.

Resin [P-8]

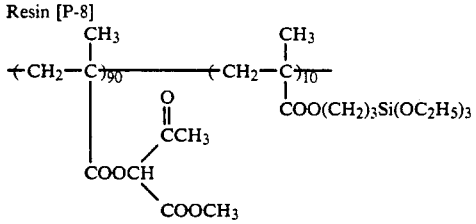

Synthetic Example 9 of Resin [P]: Resin [P-9]

A mixed solution of 9.0 g of Monomer (M-5) having the following structure, 10 g of glycidyl methacrylate, 140 g of toluene and 60 g of ethanol was heated at a temperature of 75° C. under a nitrogen stream, to which 0.8 g of 2,2'-azobis(2-cyanopentanic acid) was then added while stirring, followed by reacting for 4 hours. 0.2 g of the above described initiator was further added thereto and reacted for 3 hours.

The resulting polymer [P-9] had a weight average molecular weight of $6.8\times10^4$.

Monomer (M-5)

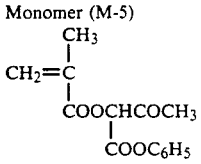

Resin [P-9]

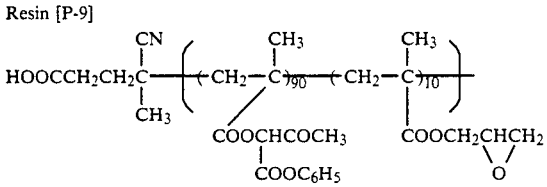

Synthetic Examples 10 to 16 of Resin [P]: Resins [P-10] to [P-16]

Synthetic Example 7 was repeated except using multifunctional monomers shown in the following Table 3 in predetermined quantities instead of 2.0 g of the divinylbenzene, thus obtaining polymers [P-10] to [P-16] each having a weight average molecular weight of $8\times10^4$ to $2\times10^5$.

TABLE 3

| Synthetic Example of Resin [P] | Resin [P] | Multifunctional Monomer | Amount used (g) |
|---|---|---|---|
| 10 | P-10 | Ethylene Glycol dimethacrylate | 2.2 |
| 11 | P-11 | Trimethylbenzene | 1.6 |
| 12 | P-12 | Propylene Glycol diacrylate | 1.8 |
| 13 | P-13 | Divinyl Adipate | 3.0 |
| 14 | P-14 | Vinyl Methacrylate | 4.0 |
| 15 | P-15 | Trimethylolpropane Trimethacrylate | 1.5 |
| 16 | P-16 | Ethylene Glycol Diacrylate | 1.0 |

Synthetic Examples 17 to 23 Resin [P]: Resins [P-17] to [P-23]

Synthetic Example 8 was repeated except using a mixed solution of 85 g of Monomer (M-4), 14 g of a monomer corresponding to a polymeric component shown in Table 4, 1.0 g of acrylic acid and 200 g of toluene to obtain a polymer.

The resulting polymer had a weight average molecular weight of $7\times10^4$ to $8.5\times10^4$.

TABLE 4

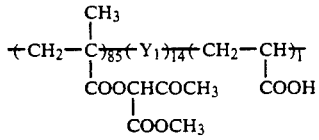

| Synthetic Example of Resin [P] | Resin [P] | Polymeric Component: Chemical Structure of $-Y_1-$ |
|---|---|---|
| 17 | [P-17] | 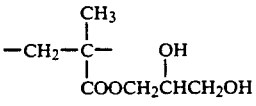 |
| 18 | [P-18] | 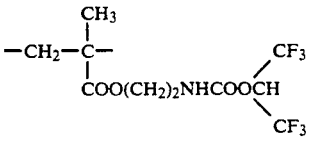 |
| 19 | [P-19] | 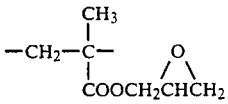 |
| 20 | [P-20] | 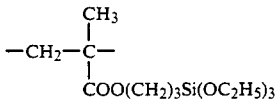 |
| 21 | [P-21] | 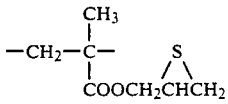 |
| 22 | [P-22] | 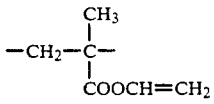 |
| 23 | [P-23] | 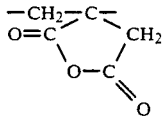 |

Synthetic Example 24 of Resin [P]: Resin [P-24]

A mixed solution of 89 g of Monomer (M-6) having the following structure, 10 g of glycidyl methacrylate, 1.0 g of acrylic acid and 200 g of toluene was heated at a temperature of 60° C. under a nitrogen stream, to which 0.8 g of A.I.V.N. was then added while stirring, followed by reacting for 4 hours. 0.5 g of A.I.V.N. was further added thereto and reacted for 3 hours.

The resulting polymer [P-24] had a weight average molecular weight of $7.3\times10^4$.

Monomer (M-6)

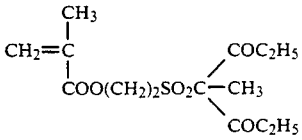

Resin [P-24]

-continued

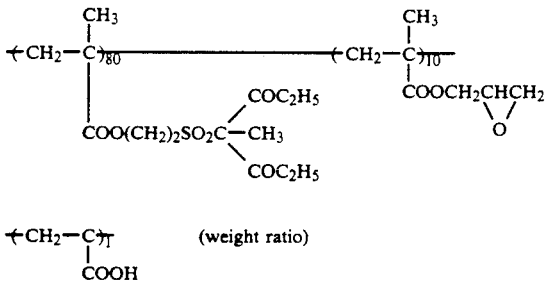

(weight ratio)

Synthetic Example 25 of Resin [P]: Resin [P-25]

A mixed solution of 63.5 g of benzyl methacrylate, 35 g of Monomer (M-7) having the following structure, 1.5 g of acrylic acid and 200 g of toluene was heated at a temperature of 75° C. under a nitrogen stream, to which 1.0 g of A.I.B.N. was then added while stirring, followed by reacting for 4 hours. 0.4 g of A.I.B.N. was further added thereto and reacted for 3 hours.

The resulting polymer [P-25] had a weight average molecular weight of $4.3\times10^4$.

Monomer (M-7)

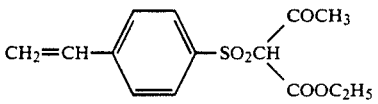

Resin [P-25]

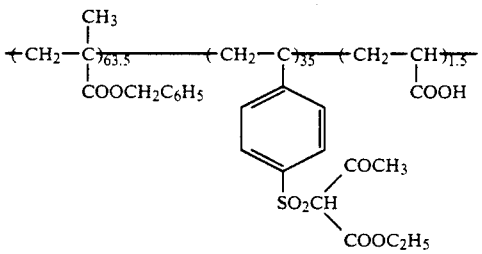

Synthetic Example 26 of Resin [P]: Resin [P-26]

A mixed solution of 88 g of Monomer (M-8) having the following structure, 10 g of 3-(triethoxysilyl)-propyl methacrylate, 2.0 g of divinylbenzene and 200 g of toluene was heated at a temperature of 60° C. under a nitrogen stream, to which 1.5 g of A.I.V.N. was then added while stirring, followed by reacting for 4 hours. 0.5 g of A.I.V.N. was further added thereto and reacted for 3 hours.

The resulting polymer [P-26] had a weight average molecular weight of $2\times10^5$.

Monomer (M-8)

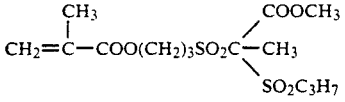

Resin [P-26]

-continued

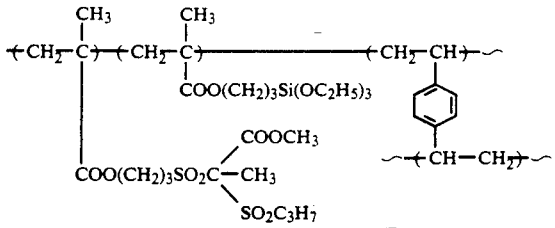

Example 1 and Comparative Examples A and B

A mixture of 30 g (as solid) of Resin [P-1], 10 g of Resin [R-1] consisting of a copolymer of benzyl methacrylate/methyl methacrylate/acrylic acid (79/20/1 by weight), having an ($\overline{M}w$) of $4.3\times10^{-4}$, 200 g of zinc oxide, 0.05 g of Rose Bengal, 0.02 g of uranine, 0.04 g of tetrabromophenol blue, 0.15 g of phthalic anhydride and 300 g of toluene was ball milled for 3 hours, to which 6 g of hexamethylene diisocyanate was then added, and the dispersion was further ball milled for 10 minutes to prepare a light-sensitive layer-forming composition. The thus resulting light-sensitive layer-forming composition was applied to a paper rendered electrically conductive to give a dry coverage of 25 $g/m^2$ by a wire bar coater, followed by drying at 100° C. for 60 minutes. The thus coated paper was allowed to stand in a dark place at a temperature of 20° C. and a relative humidity of 65% for 24 hours to prepare an electrophotographic light-sensitive material.

Comparative Example A

The procedure of Example 1 was repeated except using only 40 g of Resin [R-1] used in Example 1, as the binder resin of the photoconductive layer, to prepare an electrophotographic light-sensitive material for comparison.

Comparative Example B

The procedure of Example 1 was repeated except using only 30 g of Resin [R-2] having the following structure instead of 30 g of Resin [P-1] to prepare an electrophotographic light-sensitive material for comparison.

Resin [R-2]

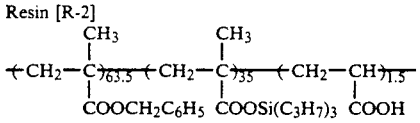

$\overline{M}w$ $4.5\times10^4$

These light-sensitive materials were then subjected to evaluation of the film property (surface smoothness), electrostatic characteristics, image quality, the oil-desensitization property of the photoconductive layer, i.e. water retention and printing property, as to samples immediately after prepared or after passage of time, thus obtaining results shown in Table 5.

TABLE 5

| | | Comparative Examples | |
|---|---|---|---|
| | Example 1 | A | B |
| Smoothness of Photoconductive Layer (sec/cc)[1] | 350 | 380 | 360 |
| Electrostatic Characteristics[2] | | | |

TABLE 5-continued

| | Example 1 | Comparative Examples A | B |
|---|---|---|---|
| $V_{10}$ (−V) | | | |
| I | 580 | 590 | 570 |
| II | 580 | 585 | 510 |
| D.R.R. (%) | | | |
| I | 88 | 90 | 87 |
| II | 85 | 87 | 79 |
| $E_{1/10}$ (lux · sec) | | | |
| I | 13.0 | 12.6 | 12.3 |
| II | 12.8 | 12.3 | 10.0 |
| Image Quality[3)] | | | |
| I | ○ good | ○ good | ○ good |
| II | ○ good | ○ good | X~Δ |
| Water Retention[4)] | ⊙ good | X background staining | ○ good |
| Printing Durability[5)] | no stain even after 10000 prints | background stain after 3000 prints | background stain from printing start |

The characteristic items described in Table 5 were evaluated as follows:

1) Smoothness of Photoconductive Layer

The resulting light-sensitive material was subjected to measurement of its smoothness (sec/cc) under an air volume of 1 cc using a Beck smoothness tester (manufactured by Kumagaya Riko KK).

2) Electrostatic Characteristics

Each of the light-sensitive material was subjected to corona discharge at a voltage of −6 kV for 20 seconds in a dark room at a temperature of 20° C. and relative humidity of 65% using a paper analyzer (Paper Analyzer SP-428, -commercial name- manufactured by Kawaguchi Denki KK) and after allowed to stand for 10 seconds, the surface potential $V_{10}$ was measured. Then, the sample was further allowed to stand in the dark room as it was for 60 seconds to measure the surface potential $V_{70}$, thus obtaining the retention of potential after the dark decay for 60 seconds, i.e., dark decay retention ratio (DRR (%)) represented by $(V_{70}/V_{10})\times 100$ (%). Moreover, the surface of the photoconductive layer was negatively charged to −400 V, by corona discharge, then irradiated with a visible ray of an illuminance of 2.0 lux and the time required for dark decay of the surface potential $V_{10}$ to 1/10 was measured to evaluate the exposure quantity $E_{1/10}$ (lux.-sec).

As samples of the light-sensitive materials, there were used Sample I after passage of 2 days from the preparation and Sample II after passage of 2 months under conditions of [45° C., 75% RH].

3) Image Quality

Each of the light-sensitive materials and an automatic printing plate making machine ELP 404 V (commercial name, manufactured by Fuji Photo Film Co.) were allowed to stand for a while day and night at normal temperature and normal humidity (20° C., 65% RH) and then subjected to plate making and forming a reproduced image, which was then visually observed to evaluate the fog and image quality as to Samples I and II, mentioned in the above described item 2).

4) Water Retention of Raw Plate

An oil-desensitizing processing solution, ELP-E (commercial name, manufactured by Fuji Photo Film, Co., pH 4.5) wad diluted with distilled water by 5 times to prepare a processing solution. This processing solution was charged in an etching processor, through which each of the light-sensitive materials was passed once. Then, the light-sensitive material was immersed in an oil-desensitizing solution (E-1) having the following recipe for 1 minute and washed with distilled water:

| Oil-desensitizing Processing Solution (E-1) | |
|---|---|
| 2-Mercaptoethanesulfonic Acid | 60 g |
| Benzyl Alcohol | 30 g |

dissolved in 1000 ml of distilled water and adjusted to pH 11 with potassium hydroxide.

Using distilled water as the dampening water, the sample was subjected to an offset printing machine (611 XLA-11, —commercial name—made by Hamada Insatsukikai Seizojo) and then to visual estimation of the degree of background staining of a print from the start of printing to 50 prints (corresponding to the forced condition to examine the degree of the water retention of a raw plate subjected to the oil-desensitizing processing).

5) Printing Durability

Sample II of each of the light-sensitive materials was subjected to formation of a toner image under the same condition as that of the above described item 3), passed 2 times through an etching processor in which a processing solution obtained by diluting ELP-E 2 times with distilled water had been charged and then immersed in the oil-desensitizing processing solution (E-1) for 1 minute. The thus processed sample, as an offset master, was subjected to an offset printing machine (Oliver 52 type—commercial name—made by Sakurai Seisakusho KK) to examine the number of prints capable of being obtained without forming background stains on the non-image areas of the print and meeting with any problem on the image quality of the image areas (The more the prints, the better the printing durability).

As can be seen from Table 5, all the light-sensitive materials of Example 1 of the present invention and Comparative Examples A and B exhibited excellent electrostatic characteristics as well as image quality as to Samples I directly after prepared.

However, when each of Samples II after storage for 2 months under severer condition of 45° C. and 75% RH was subjected to the similar estimation, the properties were deteriorated and image quality was degraded to result in background staining of non-image areas, density lowering of image areas and disappearance of letters or fine lines in Comparative Example B using the known binder resin.

In Comparative Example A using the known binder resin, the water retention of a raw plate representative of the degree of hydrophilicity of the each light-sensitive material immediately after the preparation thereof, subjected to an oil-desensitizing processing, was such that background staining took place due to adhesion of an ink.

When printing was carried out using each of Samples II after storage for a long time as a master plate for offset printing, at least 10000 prints were obtained with a good image quality and without background stains on non-image areas only in Example 1 of the present invention, but background stains occurred in printing only about 3000 prints in comparative Example A and background staining occurred from the start of printing because background staining was so much after plate making that it could not be removed even by oil-desensitizing in Comparative Example B.

This tells that only the light-sensitive material of the present invention is capable of forming constantly clear reproduced images even after storage for a long time and giving 10000 prints or more free from background stains.

Furthermore, the light-sensitive material of Example 1 of the present invention was subjected to an oil-desensitizing processing under the following conditions to examine the printing durability. The oil-desensitizing processing was carried out in an analogous manner to the item 5) except using the following processing solution (E'-1) for comparison instead of the oil-desensitizing solution (E-1) of the item 5).

Processing Solution for Comparison (E'-1) prepared by dissolving 30 g of benzyl alcohol in 1000 ml of distilled water and adjusting the pH to 11.0 with KOH. In this case, the printing durability corresponded to 3500 prints. Such a lowering of the printing durability is probably due to that the binder resin of the present invention is hardly rendered hydrophilic because of containing no nucleophilic compound in the processing solution (E'-1) for comparison.

Example 2

A mixture of 36 g (as solid) of Resin [P-4], 4 g of Resin [R-3] consisting of [benzyl methacrylate/methyl methacrylate/acrylic acid (79/20/1) weight ratio] copolymer (weight average molecular weight: $6.8\times10^4$), 200 g of zinc oxide, 0.05 g of Rose Bengal, 0.02 g of uranine, 0.04 g of tetrabromophenol blue, 0.15 g of phthalic anhydride and 300 g of toluene was ball milled for 3 hours. Further, 90 mg of phthalic anhydride and 3.9 mg of o-chlorophenol were then added to this dispersion and ball milled for 10 minutes to prepare a light-sensitive layer-forming composition, which was then applied to a paper rendered electrically conductive to give a dry coverage of 25 g/m$^2$ by a wire bar coater, followed by drying at 100° C. for 60 minutes. The thus coated paper was allowed to stand in a dark place at a temperature of 20° C. and a relative humidity of 65% for 24 hours to prepare an electrophotographic light-sensitive material.

When the resulting light-sensitive material was subjected to plate making, oil-desensitizing processing and printing in the similar manner to Example 1, 10000 or more prints of clear image was obtained without occurrence of fog on non-image areas.

Examples 3 to 9

Example 1 was repeated except using copolymers [P] shown in Table 6 instead of Resin [P-1] of the present invention, thus preparing light-sensitive materials. The weight average molecular weight of each of the copolymers [P] was in the range of $4\times10^4$ to $6\times10^4$.

TABLE 6

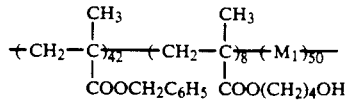

(weight ratio)

| Example | Resin of Our Invention | Copolymeric Component: Chemical Structure of $M_1$ |
|---|---|---|
| 3 | [P-27] | 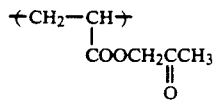 |
| 4 | [P-28] | 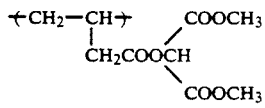 |
| 5 | [P-29] | 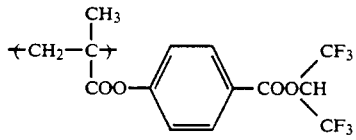 |
| 6 | [P-30] | 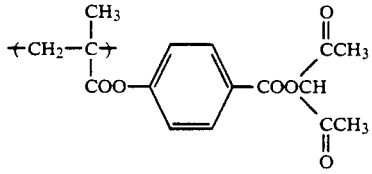 |
| 7 | [P-31] | 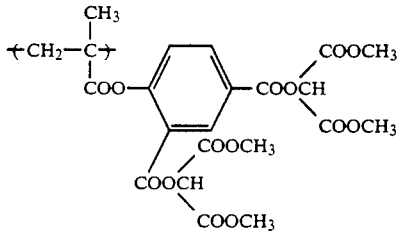 |
| 8 | [P-32] | 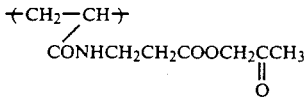 |
| 9 | [P-33] | 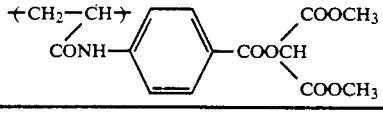 |

When each of these light-sensitive materials was processed to examine the electrostatic characteristics, image quality and printing property in an analogous manner to Example 1, similar properties or performances were obtained to Example 1.

In addition, when these light-sensitive materials were subjected to the similar examination after allowed to stand under forced conditions of [45° C., 75% RH] for 4 weeks, there was found no change from the sample before such a passage of period of time and good results were obtained.

Examples 10 to 13

Example 2 was repeated except using copolymers [P] shown in Table 7 instead of Resin [P-4] of the present invention, thus preparing light-sensitive materials. The weight average molecular weight of each of the copolymers [P] was in the range of $5\times10^4$ to $8\times10^4$.

TABLE 7

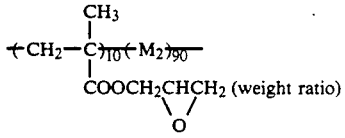

| Example | Resin of Our Invention | Copolymeric Component: Chemical Structure of $M_2$ |
|---|---|---|
| 10 | [P-34] | 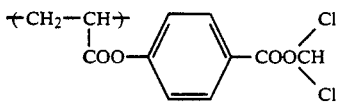 |
| 11 | [P-35] | 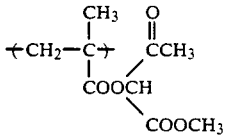 |
| 12 | [P-36] | 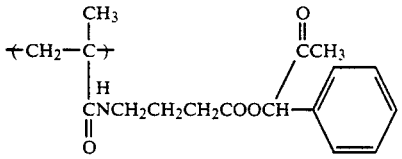 |
| 13 | [P-37] | 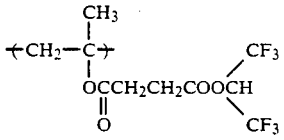 |

When each of the light-sensitive materials was subjected to plate making using an automatic printing plate making machine ELP 404 V (commercial name) in an analogous manner to Example 1, the resulting master plate for offset printing had a concentration of at least 1.2 and clear image quality. When it was subjected to an etching treatment and printing, furthermore, 10000 or more prints with a clear image were obtained without occurrence of fog or non-image areas.

When the light-sensitive materials were further subjected to the same processings as described above, except after allowing to stand under conditions of 45° C. and 75% RH for 2 months, no change occurred in the results.

Example 14

A mixture of 25 g (as solid content) of Resin [P-3] of the present invention, 15 g of Resin R-1 used in Example 1, 200 g of zinc oxide, 0.02 g of uranine, 0.04 g of Rose Bengal, 0.03 g of tetrabromophenol blue, 0.20 g of maleic anhydride and 300 g of toluene was ball milled for 2 hours. Then, 4 g of allyl methacrylate and 0.4 g of A.I.B.N. were added to the resulting dispersion and further ball milled for 10 minutes to prepare a light-sensitive layer-forming composition. The thus resulting light-sensitive layer-forming composition was applied to a paper rendered electrically conductive to give a dry coverage of 22 g/m$^2$ by a wire bar coater, followed by heating at 105° C. for 2 hours. The thus coated paper was allowed to stand in a dark place at 20° C. and 65% RH for 24 hours to prepare an electrophotographic light-sensitive material.

When the resulting light-sensitive material was subjected to plate making by means of the same apparatus as that of Example 1, the resulting master plate had a concentration of at least 1.0 and clear image.

The plate was immersed in a processing solution (E-2) consisting of an aqueous solution of 55 g of thioglycolic acid, and 100 g of benzyl alcohol dissolved in distilled water to give 1000 ml and having a pH of 11.0, adjusted by sodium hydroxide, at a temperature of 25° C. for 1 minute and then immersed and etched for 20 seconds in a solution obtained by diluting ELP-E (-commercial name-, manufactured by Fuji Photo Film Co., Ltd.) by 2 times with distilled water. The resulting plate was rendered sufficiently hydrophilic as represented by a contact angle with water of 10° or less.

When this plate was subjected to printing using the same printing machine as that of Example 1, 10000 or more prints of clear image were obtained without occurrence of fog on non-image areas. When the light-sensitive material was further subjected to the same processings as described above, except after allowing to stand under conditions of 45° C. and 75% RH for 2 months, no change appeared in the results.

Examples 15 to 19

Example 1 was repeated except using 20 g of Resin [P-5] and 20 g of Resin [R-1] instead of 30 g of Resin [P-1] and 10 g of Resin [R-1] and using compounds shown in Table 8 as a crosslinking agent instead of the hexamethylene diisocyanate, thus obtaining light-sensitive materials.

TABLE 8

| Example | Crosslinking Agent |
|---|---|
| 15 | ethylene glycol diglycidyl ether |
| 16 | Eponit 012 (-commercial name- made by Nitto Kasei KK) |
| 17 | Rika Resin PO-24 (-commercial name-, made by Shin Nippon Rika KK) |
| 18 | diphenylmethane diisocyanate |
| 19 | triphenylmethane triisocyanate |

These light-sensitive materials were subjected to plate making, etching and printing in an analogous manner to Example 1. The master plate, obtained after plate making, had a concentration of at least 1.0 and clear image quality. In printing, prints showed clear image quality without fog even after printing 10000 prints.

Examples 20 to 29

Example 2 was repeated except using 32 g of Resin [R-35] and 8 g of Resin [R-3] instead of 36 g of Resin [P-4] of the present invention and 4 g of Resin [R-3] and using compounds shown in Table 9 instead of the phthalic anhydride, as a crosslinking agent, and the o-chlorophenol, as a crosslinking catalyst, to prepare light-sensitive materials.

TABLE 9

| Example | Crosslinking Agent | Crosslinking Catalyst |
|---|---|---|
| 20 | Phthalic Anhydride | Phenol |
| 21 | Maleic Anhydride | p-Cresol |

TABLE 9-continued

| Example | Crosslinking Agent | Crosslinking Catalyst |
|---|---|---|
| 22 | Adipic Acid | — |
| 23 | Dodecenylsuccinic Anhydride | Phenol |
| 24 | Dodecenylsuccinic Anhydride | p-Cresol |
| 25 | Hexahydrophthalic Anhydride | Benzoic Acid |
| 26 | Hexahydrophthalic Anhydride | $Zn(C_{17}H_{35}COO)_2$ |
| 27 | Pyromellitic Anhydride | m-Phenylenediamine |
| 28 | Phthalic Acid | — |
| 29 | Phthalic Acid | $Zn(C_{17}H_{35}COO)_2$ |

When each of the light-sensitive materials was subjected to plate making by means of the same apparatus as that of Example 1, then to an etching treatment and to printing in a printing machine. The master plate, obtained after plate making, had a concentration of at least 1.0 and clear image quality. In printing, prints showed clear image quality without fog even after printing 10000 prints.

Examples 30 to 41

Using each of the light-sensitive materials prepared in Examples 1 to 13, master plates for offset printing were prepared by carrying out the etching treatment as in the following.

0.5 mole of each of nucleophilic compounds shown in Table 10, 100 g of each of organic solvents shown in Table 10 and 10 g of New Coal B 4 SN (-commercial name-, manufactured by Nippon Nyukazai KK) were added to distilled water to 1000 ml, the pH being adjusted to 10.0 to prepare a processing solution. Each of the light-sensitive materials was immersed and etched in a solution prepared by diluting by 2 times ELP-E with distilled water for 20 seconds and then immersed in the above described processing solution at 25° C. for 1 minute.

The thus resulting plate was subjected to printing under the same printing conditions as in Example 1. Any of the master plates gave clear image quality without fog on non-image areas even after printing 10000 prints.

TABLE 10

| Example | Light-sensitive Material | Nucleophilic Compound | Organic Solvent |
|---|---|---|---|
| 30 | Example 1 | sodium sulfite | benzyl alcohol |
| 31 | Example 2 | monoethanolamine | benzyl alcohol |
| 32 | Example 3 | diethanolamine | methyl ethyl ketone |
| 33 | Example 4 | thiomalic acid | ethylene glycol |
| 34 | Example 9 | thiosalicylic acid | benzyl alcohol |
| 35 | Example 5 | taurine | isopropyl alcohol |
| 36 | Example 6 | 4-sulfobenzene-sulfinic acid | benzyl alcohol |
| 37 | Example 7 | thioglycolic acid | ethanol |
| 38 | Example 8 | 2-mercaptoethyl-phosphonic acid | dioxane |
| 39 | Example 10 | 2-mercapto-1-aminoacetic acid | — |
| 40 | Example 11 | sodium thiosulfate | methyl ethyl ketone |
| 41 | Example 12 | ammonium sulfite | benzyl alcohol |

Example 42

A mixture of 34 g (as solid content) of Resin [P-28], 6 g of Resin [R-4] consisting of a copolymer of benzyl methacrylate/acrylic acid (95/5 by weight), having an ($\overline{M}w$) of $8.5\times10^3$, 200 g of zinc oxide, 0.018 g of a cyanine dye (I) having the following structure, 0.15 g of phthalic anhydride and 300 g of toluene was dispersed in a ball mill for 3 hours to prepare a light-sensitive layer-forming composition, which was then applied to a paper rendered electrically conductive to give a dry coverage of 20 g/m$^2$ by a wire bar coater, followed by drying at 100° C. for 30 seconds. The thus coated paper was allowed to stand in a dark place at 20° C. and 65% RH for 24 hours to prepare an electrophotographic light-sensitive material.

Cyanine Dye (I):

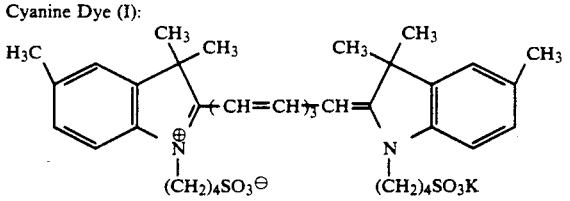

The light-sensitive material was then subjected to evaluation of the surface smoothness, electrostatic characteristics, image quality and printing property in an analogous manner to Example 1 to thus obtain the following results:

| | |
|---|---|
| Smoothness of Photoconductive Layer | 110 (sec/cc) |
| Electrostatic Characteristics[6] | $V_{10}$: −555 (V)<br>D.R.R.: 80%<br>$E_{1/10}$: 53 (erg/cm$^2$) |
| Image Quality[7] | I (20° C., 65%): good (◯)<br>II (30° C., 80%): good (◯) |
| Contact Angle with Water | 10° or less |
| Printing Durability | 8000 prints or less |

As described above, the light-sensitive material of the present invention exhibited excellent electrostatic characteristics and printing property. The electrostatic characteristics and image quality were measured by the following procedures:

6) Electrostatic Characteristics

The light-sensitive material was subjected to corona discharge at −6kV for 20 seconds in a dark room at a temperature of 20° C. and relative humidity of 65% using a paper analyzer (Paper Analyzer SP-428 -commercial name- manufacture by Kawaguchi Denki KK) and then allowed to stand for 10 seconds, at which the surface potential $V_{10}$ was measured. Then, the sample was further allowed to stand in the dark room as it was for 60 seconds to measure the surface potential $V_{70}$, thus obtaining the retention of potential after the dark decay for 60 seconds, i.e., dark decay retention ratio (DRR (%)) represented by $(V_{70}/V_{10})\times100$ (%). Moreover, the surface of the photoconductive layer was negatively charged to −400 V by corona discharge, then irradiated with monochromatic light of a wavelength of 780 nm and the time required for dark decay of the surface potential ($V_{10}$) to 1/10 was measured to evaluate an exposure quantity $E_{1/10}$(erg/cm$^2$).

7) Image quality

The light-sensitive material was allowed to stand for a whole day and night under the following ambient conditions, charged at −5 kV, imagewise exposed rapidly at a pitch of 25 μm and a scanning speed of 330 m/sec under irradiation of 64 erg/cm$^2$ on the surface of the light-sensitive material using a gallium-aluminum-arsenic semiconductor laser (oscillation wavelength: 780 nm) with an output of 2.8 mW as a light source, developed with a liquid developer, ELP-T (-commercial name-, manufactured by Fuji Photo Film Co., Ltd.)

and fixed to obtain a reproduced image which was then subjected to visual evaluation of the fog and image quality:

| | |
|---|---|
| I | 20° C., 65% RH |
| II | 30° C., 80% RH |

Example 43

A mixture of 7 g of Resin [P-30], 33 g of the following resin (R-5), 200 g of zinc oxide, 0.018 g of a cyanine dye (II) having the following structure, 0.20 g of maleic anhydride and 300 g of toluene was dispersed in a ball mill for 3 hours to prepare a light-sensitive layer-forming composition, which was then applied to a paper rendered electrically conductive to give a dry coverage of 25 g/m$^2$ by means of a wire bar coater, followed by drying at 110° C. for 30 seconds. The thus coated paper was allowed to stand in a dark place at 20° C. and 65% RH for 24 hours to prepare an electrophotographic light-sensitive material.

Resin R-5

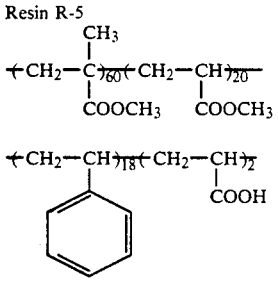

$\overline{M}w$ 6.5 × 10$^4$ (weight component ratio)

Cyanine Dye II

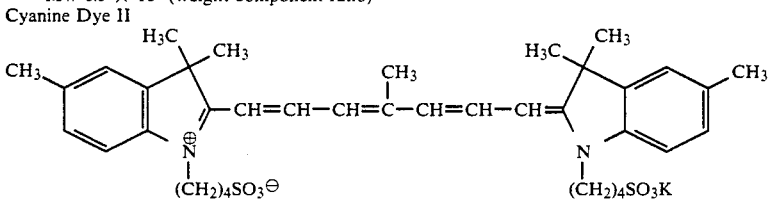

The light-sensitive material was then subjected to evaluation of the surface smoothness, electrostatic characteristics, image quality and printing property in an analogous manner to Example 42 to thus obtain the following results:

| | |
|---|---|
| Smoothness of Photoconductive Layer | 130 (sec/cc) |
| Electrostatic Characteristics[6)] | $V_{10}$: −560 (V)<br>D.R.R.: 80%<br>$E_{1/10}$: 58 (erg/cm$^2$) |
| Image Quality[7)] | I (20° C., 65%): good<br>II (30° C., 80%): good |
| Contact Angle with Water | 10° or less |
| Printing Durability | 9000 prints or less |

As described above, the light-sensitive material of the present invention exhibited excellent electrostatic characteristics and printing property.

Example 44 and Comparative Example C

A mixture of 30 g (as solid) of Resin [P-5], 10 g of Resin [B-1] consisting of a copolymer of benzyl methacrylate/glycidyl methacrylate/acrylic acid (89/10/1 by weight), having an ($\overline{M}w$) of 4.3×10$^4$, 200 g of zinc oxide, 0.05 g of Rose Bengal, 0.02 g of uranine, 0.04 g of tetrabromophenol blue, 0.15 g of salicylic acid and 300 g of toluene was ball milled for 3 hours, to which 0.2 g of phthalic anhydride and 0.01 g of o-chlorophenol were then added, and the dispersion was further ball milled for 10 minutes to prepare a light-sensitive layer-forming composition. The thus resulting light-sensitive layer-forming composition was applied to a paper rendered electrically conductive to give a dry coverage of 25 g/m$^2$ by a wire bar coater, followed by drying at 140° C. for 30 minutes. The thus coated paper was allowed to stand in a dark place at a temperature of 20° C. and a relative humidity of 65% for 24 hours to prepare an electrophotographic light-sensitive material.

Comparative Example C

The procedure of Example 44 was repeated except using 30 g of Resin [R-6] for comparison, having the following structure instead of 30 g of Resin [P-5] to prepare an electrophotographic light-sensitive material for comparison.

Resin for Comparison [R-6]

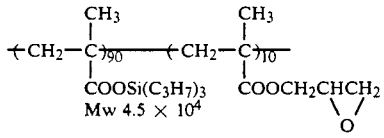

These light-sensitive materials were then subjected to evaluation of the film property (surface smoothness), electrostatic characteristics, image quality, the oil-desensitization property of the photoconductive layer, i.e. water retention and printing property, as to samples immediately after prepared or after passage of time, thus obtaining results shown in Table 11.

TABLE 11

| | Example 44 | Comparative Example C |
|---|---|---|
| Smoothness of Photoconductive Layer (sec/cc)[1)] | 350 | 355 |
| Electrostatic Characteristics[2)] | | |
| $V_{10}$ (−V) | | |
| I | 630 | 600 |
| II | 610 | 575 |
| D.R.R. (%) | | |

TABLE 11-continued

| | Example 44 | Comparative Example C |
|---|---|---|
| I | 88 | 88 |
| II | 85 | 84 |
| $E_{1/10}$ (lux · sec) | | |
| I | 35 | 36 |
| II | 39 | 41 |
| Image Quality[3)] | | |
| I | ○ good | ○ good |
| II | ○ good | ○ good |
| Water Retention[4)] | ⊙ good | ○ good |
| Printing Durability[5)] | no stain even after 10000 prints | background stain from printing start |

The characteristic items 1) to 5) described in Table 11 were evaluated in the similar manner to Example 1, Table 5.

As can be seen from Table 11, all the light-sensitive materials of Example 44 of the present invention and Comparative Example C exhibited excellent electrostatic characteristics as well as image quality as to Samples I directly after prepared.

However, when each of Samples II after storage for 2 months under severer condition of 45° C. and 75% RH was subjected to the similar estimation, the properties were deteriorated and image quality was degraded to result in background staining of non-image areas, density lowering of image areas and disappearance of letters or fine lines in Comparative Example C using the known binder resin.

When printing was carried out using each of Samples II after storage for a long time as a master plate for offset printing, at least 10000 prints were obtained with a good image quality and without background stains on non-image areas only in Example 1 of the present invention, but in comparative Example C, background staining occurred from the start of printing because background staining was so much after plate making that it could not be removed even by oil-desensitizing.

This tells that only the light-sensitive material of the present invention is capable of forming constantly clear reproduced images even after storage for a long time and giving 10000 prints or more free from background stains.

Furthermore, the light-sensitive material of Example 44 of the present invention was subjected to an oil-desensitizing processing under the following conditions to examine the printing durability. The oil-desensitizing processing was carried out in an analogous manner to the item 5) except using the following processing solution (E'-1) for comparison instead of the oil-desensitizing solution (E-1) of the item 5).

Processing Solution for Comparison (E'-1) prepared by dissolving 30 g of benzyl alcohol in 1000 ml of distilled water and adjusting the pH to 11.0 with KOH. In this case, the printing durability corresponded to 3500 prints. Such a lowering of the printing durability is probably due to that the binder resin of the present invention is hardly rendered hydrophilic because of containing no nucleophilic compound in the processing solution (E'-1) for comparison.

Example 45

A mixture of 34 g (as solid) of Resin [P-8], 3 g of Resin [R-7] consisting of [benzyl methacrylate/acrylic acid (99.5/0.5) weight ratio] copolymer (weight average molecular weight: $3.5\times10^4$), 200 g of zinc oxide, 0.05 g of Rose Bengal, 0.02 g of uranine, 0.04 g of tetrabromophenol blue, 0.15 g of phthalic anhydride and 300 g of toluene was dispersed for 5 minutes in a homogenizer (made by Nippon Seiki KK) at a revolution number (one broken microdrill) of $10^4$ rpm. Further, 3 g of Resin [B 2] having the following structure and 0.001 g of gluconic acid were then added to this dispersion and dispersed at a revolution number of $1\times10^3$ rpm for 2 minutes to prepare a light-sensitive layer-forming composition, which was then applied to a paper rendered electrically conductive to give a dry coverage of 25 g/m$^2$ by a wire bar coater, followed by drying at 120° C. for 60 minutes. The thus coated paper was allowed to stand in a dark place at a temperature of 20° C. and a relative humidity of 65% for 24 hours to prepare an electrophotographic light-sensitive material.

Resin [B-2]

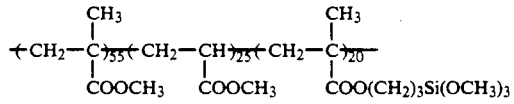

When the resulting light-sensitive material was subjected to plate making, oil-desensitizing processing and printing in the similar manner to Example 44, 10000 or more prints of clear image was obtained without occurrence of fog on non-image areas.

Examples 46 to 51

Example 44 was repeated except using copolymers [P] shown in Table 12 instead of Resin [P-5] of the present invention, thus preparing light-sensitive materials. The weight average molecular weight of each of the copolymers [P] was in the range of $4\times10^4$ to $6\times10^4$.

TABLE 12

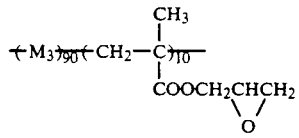

$\overline{M}w$ $6\times10^4\sim8\times10^4$ (weight ratio)

| Example | Resin of Our Invention | Copolymeric Component: Chemical Structure of $M_3$ |
|---|---|---|
| 46 | [P-38] | 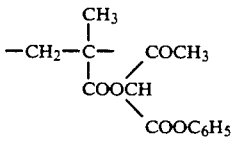 |
| 47 | [P-39] | 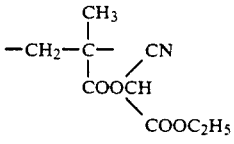 |

TABLE 12-continued

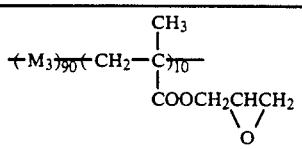

$\overline{M}w$ 6 × $10^4$~8 × $10^4$ (weight ratio)

| Example | Resin of Our Invention | Copolymeric Component: Chemical Structure of $M_3$ |
|---|---|---|
| 48 | [P-40] | 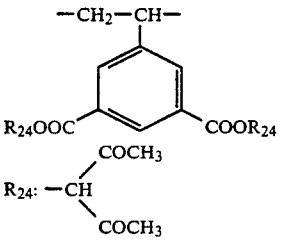 |
| 49 | [P-41] | 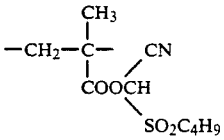 |
| 50 | [P-42] | 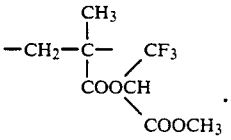 |

TABLE 12-continued

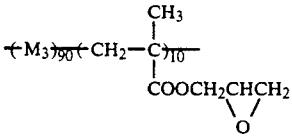

$\overline{M}w$ 6 × $10^4$~8 × $10^4$ (weight ratio)

| Example | Resin of Our Invention | Copolymeric Component: Chemical Structure of $M_3$ |
|---|---|---|
| 51 | [P-43] | 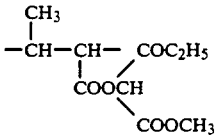 |

When each of these light-sensitive materials was processed to examine the electrostatic characteristics, image quality and printing property in an analogous manner to Example 44, similar properties or performances were obtained to Example 44.

In addition, when these light-sensitive materials were subjected to the similar examination after allowed to stand under forced conditions of [45° C., 75% RH] for 4 weeks, there was found no change from the sample before such a passage of period of time and good results were obtained.

Examples 52 to 59

Example 45 was repeated except using copolymers [P] shown in Table 13 instead of Resin [P-8] of the present invention and using resin [B] and crosslinking additives shown in Table 13, thus preparing light-sensitive materials. The weight average molecular weight of each of the copolymers [B] was in the range of $5\times10^4$ to $8\times10^4$.

TABLE 13

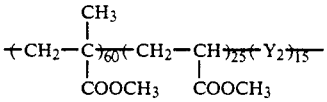

(weight ratio)

| Example | Resin [P] | Resin [B] | Copolymeric Component of Resin [B]: Chemical Structure of $Y_2$ | Crosslinking Additives | (wt %) |
|---|---|---|---|---|---|
| 52 | P-17 | B-3 | 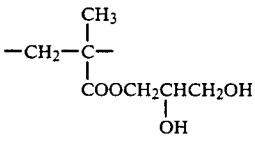 | $R_{25}$—OOCN$(CH_2)_6$NHCOOR$_{25}$ 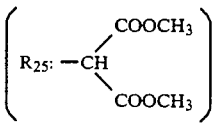 | 0.5 |
| | | | | Tetrabutoxytitanate | 0.001 |
| 53 | P-18 | B-4 | 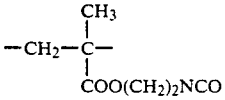 | Propylene Glycol<br>Dibutyllauratetin | 0.8<br>0.001 |
| 54 | P-10 | B-5 | 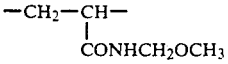 | — | — |

TABLE 13-continued

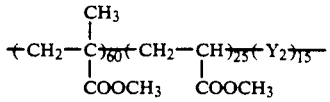

(weight ratio)

| Example | Resin [P] | Resin [B] | Copolymeric Component of Resin [B]: Chemical Structure of $Y_2$ | Crosslinking Additives | (wt %) |
|---|---|---|---|---|---|
| 55 | P-20 | B-6 | 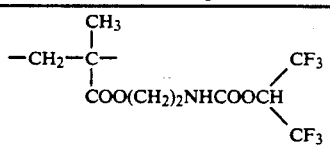 | 3-(N,N-dimethylamino)-propylamine | 0.1 |
| 56 | P-22 | B-7 | 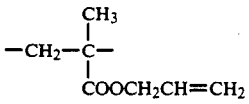 | Divinyl Adipate<br>Benzoyl Peroxide | 1.0<br>0.002 |
| 57 | P-23 | B-8 | 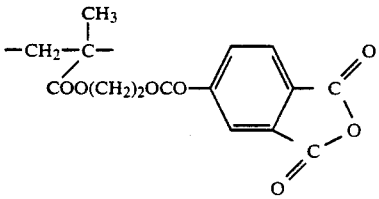 | Ethylene Glycidyl Ether<br>Phenol | 0.8<br>0.001 |
| 58 | P-20 | B-9 | 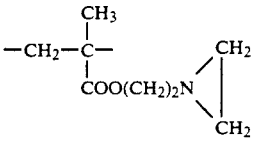 | Glutaric Anhydride<br>o-Chlorophenol | 0.3<br>0.001 |
| 54 | P-18 | B-5 |  | Dibutyllauratetin | 0.002 |

When each of the light-sensitive materials was subjected to plate making using an automatic printing plate making machine ELP 404 V in an analogous manner to Example 44, the resulting master plate for offset printing had a concentration of at least 1.2 and clear image quality. When it was subjected to an etching treatment and printing, furthermore, 10000 or more prints with a clear image were obtained without occurrence of fog on non-image areas.

When the light-sensitive materials were further subjected to the same processings as described above, except after allowing to stand under conditions of 45° C. and 75% RH for 2 months, no change occurred in the results.

Example 60

A mixture of 31 g of Resin [P-44] having the following structure, 200 g of zinc oxide, 0.04 g of Rose Bengal, 0.02 g of uranine, 0.03 g of tetrabromophenol blue, 0.20 g of maleic anhydride and 300 g of toluene was dispersed for 5 minutes in a homogenizer at a revolution number of $10^4$ rpm. Further, 5 g of Resin [B-11] having the following structure, 3 g of ethylene glycol dimethacyrlate and 0.4 g of A.I.B.N. were then added to this dispersion and dispersed at a revolution number of $1\times10^3$ rpm for 1 minute in the homogenizer to prepare a light-sensitive layer-forming composition, which was then applied to a paper rendered electrically conductive to give a dry coverage of 22 g/m$^2$ by a wire bar coater, followed by drying at 120° C. for 2 hours. The thus coated paper was allowed to stand in a dark place at a temperature of 20° C. and a relative humidity of 65% for 24 hours to prepare an electrophotographic light-sensitive material.

Resin [P-44]

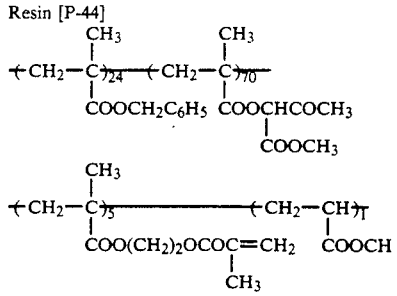

$\overline{M}w$ 6.5 × $10^4$

Resin [B-11]

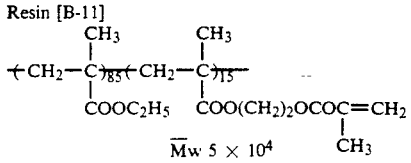

$\overline{M}w$ 5 × $10^4$

When the resulting light-sensitive material was subjected to plate making by means of the same apparatus as that of Example 1, the resulting master plate had a concentration of at least 1.0 and clear image.

The plate was immersed in a processing solution (E-2) consisting of an aqueous solution of 55 g of thioglycolic acid, and 100 g of benzyl alcohol dissolved in distilled water to give 1000 ml and having a pH of 11.0 with NaOH at a temperature of 25° C. for 1 minute and then immersed and etched for 20 seconds in a solution obtained by diluting ELP-E by 2 times with distilled water. The resulting plate was rendered sufficiently hydrophilic as represented by a contact angle with water of 10° or less.

When this plate was subjected to printing using the same printing machine as that of Example 44, 10000 or more prints of clear image were obtained without occurrence of fog on non-image areas. When the light-sensitive material was further subjected to the same processings as described above, except after allowing to stand under conditions of 45° C. and 75% RH for 2 months, no change appeared in the results.

Examples 61 to 72

Using each of the light-sensitive materials prepared in Examples 44 to 60, master plates for offset printing were prepared by carrying out the etching treatment as in the following.

0.5 mole of each of nucleophilic compounds shown in Table 14, 100 g of each of organic solvents shown in Table 14 and 10 g of New Coal B 4 SN (-commercial name-, manufactured by Nippon Nyukazai KK) were added to distilled water to 1000 ml, the pH being adjusted to 10.0 to prepare a processing solution. Each of the light-sensitive materials was immersed and etched in a solution prepared by diluting by 2 times ELP-E with distilled water for 20 seconds and then immersed in the above described processing solution at 25° C. for 1 minute.

The thus resulting plate was subjected to printing under the same printing conditions as in Example 44. Any of the master plates gave clear image quality without fog on non-image areas even after printing 10000 prints.

TABLE 14

| Example | Light-sensitive Material | Nucleophilic Compound | Organic Solvent |
|---|---|---|---|
| 61 | Example 45 | sodium sulfite | benzyl alcohol |

TABLE 14-continued

| Example | Light-sensitive Material | Nucleophilic Compound | Organic Solvent |
|---|---|---|---|
| 62 | Example 46 | monoethanolamine | benzyl alcoyol |
| 63 | Example 48 | diethanolamine | methyl ethyl ketone |
| 64 | Example 49 | thiomalic acid | ethylene glycol |
| 65 | Example 51 | 2-mercaptoethanol | benzyl alcohol |
| 66 | Example 52 | taurine | isopropyl alcohol |
| 67 | Example 54 | 4-sulfobenzene-sulfinic acid | benzyl alcohol |
| 68 | Example 55 | DBU (1,8-diazabicyclo[5,4,0]-7-undecene | ethanol |
| 69 | Example 59 | 2-mercaptoethyl-phosphonic acid | dioxane |
| 70 | Example 60 | serine | — |
| 71 | Example 56 | sodium thiosulfate | methyl ethyl ketone |
| 72 | Example 50 | benzenesulfinic acid | benzyl alcohol |

Each of the light-sensitive materials was sufficiently rendered hydrophilic as represented by a contact angle with water of 10° or less. When this plate was subjected to printing, 10000 or more prints of clear image were obtained without occurrence of fog on non-image areas.

When the light-sensitive material was further subjected to the same processings as described above, except after allowing to stand under conditions of 45° C. and 75% RH for 3 weeks, no change appeared in the results.

Examples 73 to 74

Example 60 was repeated except using 31 g of Resin [P] shown in Table 15 instead of Resin [P-44], thus preparing light-sensitive materials, but after the drying to touch, the following procedure was carried out. The light-sensitive material was irradiated by a high voltage mercury lamp of 400 W from a distance of 30 cm for 5 minutes and then allowed to stand under conditions of 20° C. and 65% RH for 24 hours to prepare a lithographic printing plate precursor.

When this was subjected to estimation of the electrostatic characteristics and printing property in an analogous manner to Example 60, there were obtained good electrostatic characteristics and a printing durability of at least 10000 prints.

TABLE 15

| Example | Resin [P] | Copolymeric Composition (weight ratio) |
|---|---|---|
| 73 | [P-45] | 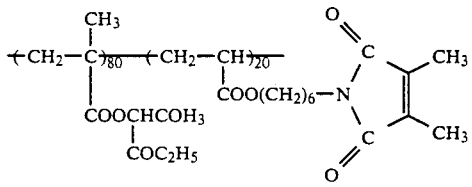 $\overline{M}w$ 4.0 × $10^4$ |
| 74 | [P-46] | 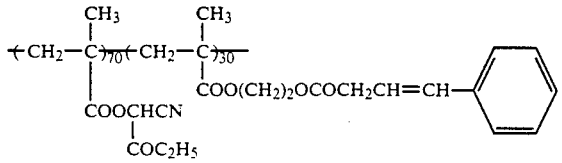 $\overline{M}w$ 6.5 × $10^4$ |

Example 75 and Comparative Example D

A mixture of 30 g (as solid) of Resin [P-24], 10 g of a resin (R-1) consisting of a copolymer of benzyl methacrylate/methyl methacrylate/acrylic acid (79/20/1 by weight), having an ($\overline{M}w$) of $4.3\times10^{-4}$, 200 g of zinc oxide, 0.05 g of Rose Bengal, 0.02 g of uranine, 0.04 g of tetrabromphenol blue, 0.15 g of salicylic acid and 300 g of toluene was ball milled for 3 hours, to which 0.25 g of phthalic anhydride and 0.01 g of o-chlorophenol were then added, and the dispersion was further ball milled for 10 minutes to prepare a light-sensitive layer-forming composition. The thus resulting light-sensitive layer-forming composition was applied to a paper rendered electrically conductive to give a dry coverage of 25 g/m$^2$ by a wire bar coater, followed by drying at 100° C. for 30 seconds and heating at 140° C. for 1 hr. The thus coated paper was allowed to stand in a dark place at a temperature of 20° C. and a relative humidity of 65% for 24 hours to prepare an electrophotographic light-sensitive material.

Comparative Example D

The procedure of Example 75 was repeated except using only 30 g of Resin [R-8] for comparison having the following structue instead of 30 g of Resin [P-24] to prepare an electrophotographic light-sensitive material for comparison.

Resin [R-8] for Comparison

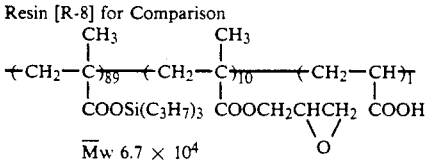

$\overline{M}w$ 6.7 × 10$^4$

These light-sensitive materials were then subjected to evaluation of the film property (surface smoothness), electrostatic characteristics, image quality, the oil-desensitization property of the photoconductive layer, i.e. water retention and printing property, as to samples immediately after prepared or after passage of time, thus obtaining results shown in Table 16.

TABLE 16

| | Example 75 | Comparative Example D |
|---|---|---|
| Smoothness of Photoconductive Layer (sec/cc)[1] | 300 | 350 |
| Electrostatic Characteristics[2] | | |
| $V_{10}$ (−V) | | |
| I | 570 | 560 |
| II | 550 | 540 |
| D.R.R. (%) | | |
| I | 88 | 85 |
| II | 85 | 80 |
| $E_{1/10}$ (lux · sec) | | |
| I | 12.8 | 13.5 |
| II | 13.3 | 14.2 |
| Image Quality[3] | | |
| I | ○ good | ○ good |
| II | ○ good | Δ fine lines or letters found slightly faint |
| Water Retention[4] | ◎ good | ○ good |
| Printing Durability[5] | no stain even after 10000 prints | background stain from printing start |

The characteristic items 1) to 5) described in Table 16 were evaluated in the similar manner to Example 1.

As can be seen from Table 16, all the light-sensitive materials of Example 75 of the present invention and Comparative Example D exhibited excellent electrostatic characteristics as well as image quality as to Samples I directly after prepared.

However, when each of Samples II after storage for 2 months under severer condition of 45° C. and 75% RH was subjected to the similar estimation, the properties were deteriorated and image quality was degraded to result in background staining of non-image areas, density lowering of image areas and disappearance of letters or fine lines in Comparative Example D using the known binder resin.

Even in Comparative Example D using the known binder resin, the water retention of a raw plate representative of the degree of hydrophilicity of the each light-sensitive material immediately after the preparation thereof, subjected to an oil-desensitizing processing, was such that background staining did not take place due to adhesion of an ink, and was good.

When printing was carried out using each of Samples II after storage for a long time as a master plate for offset printing, at least 10000 prints were obtained with a good image quality and without background stains on non-image areas only in Example 75 of the present invention, but background staining occurred from the start of printing because background staining was so much after plate making that it could not be removed even by oil-desensitizing in Comparative Example D.

This tells that only the light-sensitive material of the present invention is capable of forming constantly clear reproduced images even after storage for a long time and giving 10000 prints or more free from background stains.

Furthermore, the light-sensitive material of Example 75 of the present invention was subjected to an oil-desensitizing processing under the following conditions to examine the printing durability. The oil-desensitizing processing was carried out in an analogous manner to the item 5) except using the following processing solution (E'-1) for comparison instead of the oil-desensitizing solution (E-1) of the item 5).

Processing Solution for Comparison (E'-1) prepared by dissolving 30 g of benzyl alcohol in 1000 ml of distilled water and adjusting the pH to 11.0 with KOH. In this case, the printing durability corresponded to 6000 prints. Such a lowering of the printing durability is probably due to that the binder resin of the present invention is hardly rendered hydrophilic because of containing no nucleophilic compound in the processing solution (E'-1) for comparison.

Examples 76 to 89

Example 75 was repeated except using copolymers [P] shown in Table 17 instead of Resin [P-24] of the present invention, thus preparing light-sensitive materials. The weight average molecular weight of each of the copolymers [P] was in the range of $4\times10^4$ to $6\times10^4$.

TABLE 17

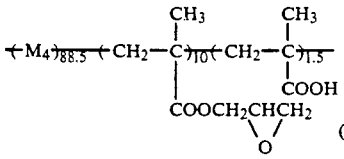

(weight ratio)

| Example | Resin of Present Invention | Copolymeric Component: Chemical Structure of $M_4$ |
|---|---|---|
| 76 | [P-47] | 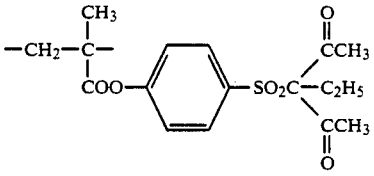 |
| 77 | [P-48] | 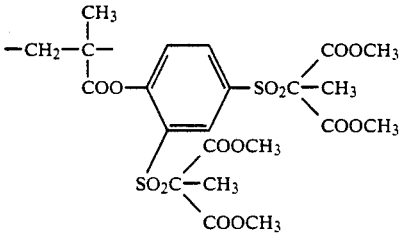 |
| 78 | [P-49] | 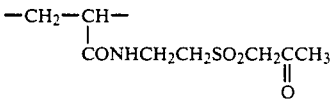 |
| 79 | [P-50] | 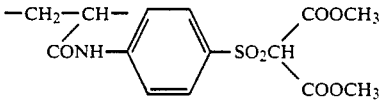 |
| 80 | [P-51] | 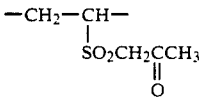 |
| 81 | [P-52] | 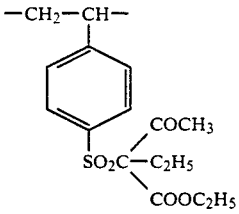 |
| 82 | [P-53] | 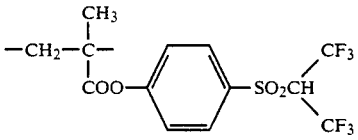 |
| 83 | [P-54] | 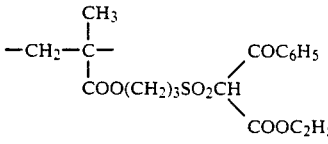 |

TABLE 17-continued

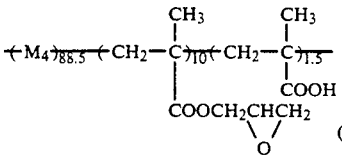

(weight ratio)

| Example | Resin of Present Invention | Copolymeric Component: Chemical Structure of $M_4$ |
|---|---|---|
| 84 | [P-55] | 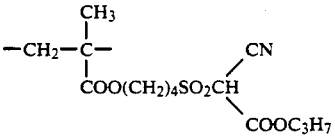 |
| 85 | [P-56] | 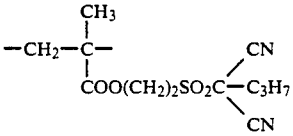 |
| 86 | [P-57] | 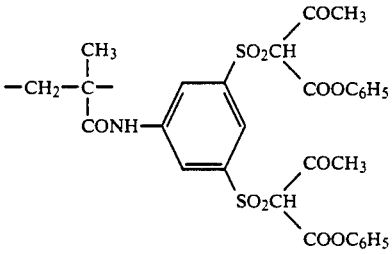 |
| 87 | [P-58] | 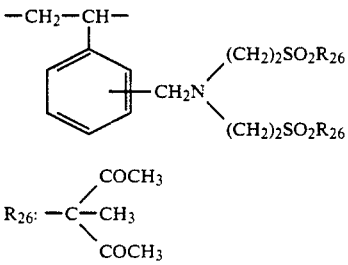 |
| 88 | [P-59] | 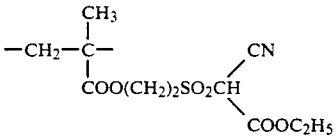 |
| 89 | [P-60] | 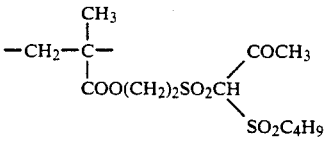 |

When each of these light-sensitive materials was processed to examine the electrostatic characteristics, image quality and printing property in an analogous manner to Example 75, similar properties or performances were obtained to Example 75.

In addition, when these light-sensitive materials were subjected to the similar examination after allowed to stand under forced conditions of [45° C., 75% RH] for 4 weeks, there was found no change from the sample before such a passage of period of time and good results were obtained.

Example 90

A mixture of 36 g (as solid) of Resin [P-26], 4 g of Resin [R-3] consisting of [benzyl methacrylate/methyl methacrylate/acrylic acid (79/20/1) weight ratio] copolymer (weight average molecular weight: $6.8\times10^4$), 200 g of zinc oxide, 0.05 g of Rose Bengal, 0.02 g of uranine, 0.04 g of tetrabromophenol blue, 0.15 g of phthalic anhydride and 300 g of toluene was ball milled for 3 hours. Further, 0.03 g of gluconic acid was then added to this dispersion and ball milled for 5 minutes to prepare a light-sensitive layer-forming composition, which was then applied to a paper rendered electrically conductive to give a dry coverage of 25 g/m$^2$ by a wire bar coater, followed by drying at 110° C. for 60 minutes. The thus coated paper was allowed to stand in a dark place at a temperature of 20° C. and a relative humidity of 65% for 24 hours to prepare an electrophotographic light-sensitive material.

When the resulting light-sensitive material was subjected to plate making, oil-desensitizing processing and printing in the similar manner to Example 75, 10000 or more prints of clear image was obtained without occurrence of fog on non-image areas.

Examples 91 to 97

In synthetic Example of Resin [P-26] of the present invention, 2.0 g of each of multi-functional monomers shown in Table 18 was used instead of 2.0 g of divinyl benzene to prepare Resins [P-61] to P-67]. The weight average molecular weight of each of the copolymers [P] was in the range of $8\times10^4$ to $20\times10^4$.

Further, Example 90 was repeated using each of Resins shown in Table 18 instead of Resin [P-26] to prepare an electrophotographic light-sensitive material.

TABLE 18

| Example | Resin [P] | Multifunctional Monomer |
|---|---|---|
| 91 | [P-61] | Ethylene Glycol Dimethacrylate |
| 92 | [P-62] | Trivinyl Benzene |
| 93 | [P-63] | Propylene Glycol Dimethacrylate |
| 94 | [P-64] | Ethylene Glycol Diacrylate |
| 95 | [P-65] | Trimethylolpropane Trimethacrylate |
| 96 | [P-66] | Vinyl Methacrylate |
| 97 | [P-67] | Divnyl Adipate |

When each of the light-sensitive materials prepared was subjected to plate making using an automatic printing plate making machine ELP 404 V in an analogous manner to Example 75, the resulting master plate for offset printing had a concentration of at least 1.2 and clear image quality. When it was subjected to an etching treatment and printing, furthermore, 10000 or more prints with a clear image were obtained without occurrence of fog on non-image areas.

When the light-sensitive materials were further subjected to the same processings as described above, except after allowing to stand under conditions of 45° C. and 75% RH for 3 weeks, no change occurred in the results.

Example 98

A mixture of 25 g (as solid content) of Resin P-25] of the present invention, obtained in Synthetic Example 25, 15 g of Resin R-8 used in Example 75, 200 g of zinc oxide, 0.02 g of uranine, 0.04 g of Rose Bengal, 0.03 g of tetrabromphenol blue, 0.20 g of maleic anhydride and 300 g of toluene was ball milled for 2 hours. Then, 4 g of allyl methacrylate and 0.4 g of A.I.B.N. were added to the resulting dispersion and further ball milled for 10 minutes to prepare a light-sensitive layer-forming composition. The thus resulting light-sensitive layer-forming composition was applied to a paper rendered electrically conductive to give a dry coverage of 22 g/m$^2$ by a wire bar coater, followed by heating at 105° C. for 2 hours. The thus coated paper was then allowed to stand in a dark place at 20° C. and 65% RH for 24 hours to prepare an electrophotographic light-sensitive material.

When the resulting light-sensitive material was subjected to plate making by means of the same apparatus as that of Example 75, the resulting master plate had a concentration of at least 1.0 and clear image.

The plate was immersed in a processing solution (E-2) consisting of an aqueous solution of 55 g of thioglycolic acid, and 100 g of benzyl alcohol dissolved in distilled water to give 1000 ml and having a pH of 11.0, adjusted by sodium hydroxide, at a temperature of 25° C. for 1 minute and then immersed and etched for 20 seconds in a solution obtained by diluting ELP-E by 2 times with distilled water. The resulting plate was rendered sufficiently hydrophilic as represented by a contact angle with water of 10° or less.

When this plate was subjected to printing using the same printing machine as that of Example 75, 8000 or more prints of clear image were obtained without occurrence of fog on non-image areas. When the light-sensitive material was further subjected to the same processings as described above, except after allowing to stand under conditions of 45° C. and 75% RH for 2 months, no change appeared in the results.

Examples 99 to 108

Example 75 was repeated except using 30 g of Resin [P] and a predetermined amount of crosslinking compounds shown in Table 19 instead of 30 g of Resin [P-24] of the present invention, 0.25 g of the phthalic anhydride and 0.01 g of the o-chlorophenol to prepare light-sensitive materials.

TABLE 19
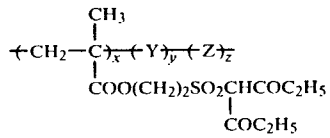
$\overline{M}w$: $6 \times 10^4 \sim 8 \times 10^4$
| Example | Binder Resin [P] [P] | —Y— | —Z— | (x/y/z) weight ratio | Crosslinking Compound | |
|---|---|---|---|---|---|---|
| 99 | P-68 | 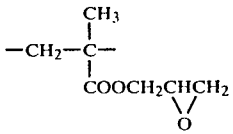 | 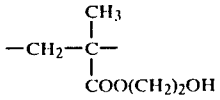 | 90/5/5 | Acetyl Acetone Zirconium Salt | 0.1 g |
| 100 | P-69 | 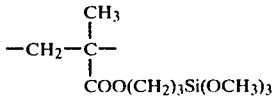 | — | 90/10/0 | — | |
| 101 | P-70 | 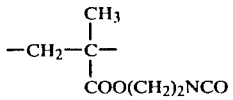 | — | 92/8/0 | Ethylene Glycol<br>Tetra(butoxy)titanate | 0.3 g<br>0.001 g |
| 102 | P-71 | 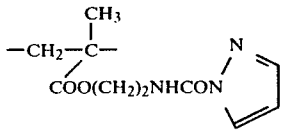 | 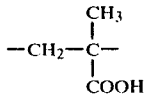 | 88.5/10/1.5 | N,N-dimethylamino Propanol | 0.2 g |
| 103 | P-72 | 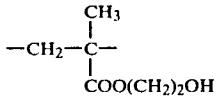 | 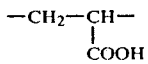 | 84/15/1.0 | $R_{27}CO_2CNH(CH_2)_6NHCO_2R_{27}$<br>$R_{27}$: $-CH(CF_3)_2$<br>Dibutyltin Laurate | 0.5 g<br><br>0.008 g |

TABLE 19-continued

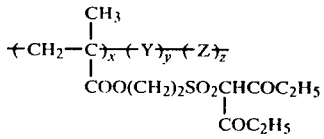

$\overline{M}w$: $6 \times 10^4 \sim 8 \times 10^4$

| Example | Binder Resin [P] [P] | —Y— | —Z— | (x/y/z) weight ratio | Crosslinking Compound | |
|---|---|---|---|---|---|---|
| 104 | P-73 | 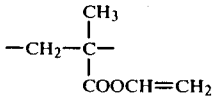 | 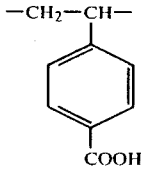 | 79/20/1.0 | Divinyl Adipate<br>Azobis (isovaleronitrile) | 2 g<br>0.02 g |
| 105 | P-74 | 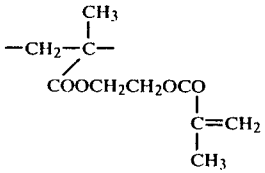 | 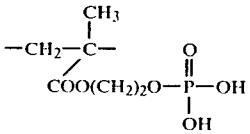 | 89.2/10/0.8 | Ethylene Glycol Dimethacrylate<br>Benzoyl Peroxide | 2.5 g<br>0.01 g |
| 106 | P-75 | 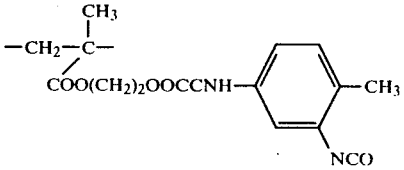 | 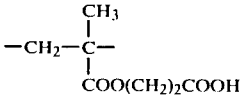 | 88.7/10/1.3 | Propylene Glycol<br>Butyl Titanate Dimer | 1 g<br>0.02 g |
| 107 | P-76 | 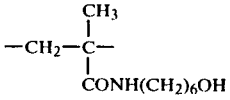 | 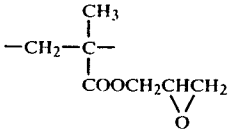 | 80/15/5 | Phthalic Anhydride<br>Acetyl Acetone Zirconium Salt | 0.25 g<br>0.1 g |
| 108 | P-77 | 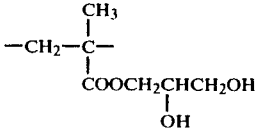 | 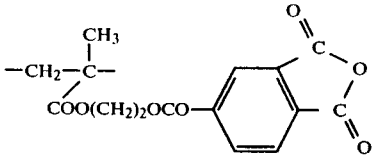 | 85/5/10 | Ethylene Glycol<br>Glycidyl Ether<br>p-cyanophenol | 0.8 g<br>0.05 g |

When each of the light-sensitive material was subjected to plate making by means of the same apparatus as that of Example 75, then to an etching treatment and to printing in a printing machine. The master plate, obtained after plate making, had a concentration of at least 1.0 and clear image quality. In printing, prints showed clear image quality without fog even after printing at least 10000 prints.

Examples 109 to 120

Using each of the light-sensitive materials prepared in Examples 75 to 87, master plates for offset printing were prepared by carrying out the etching treatment as in the following.

0.5 mole of each of nucleophilic compounds shown in Table 20, 100 g of each of organic solvents shown in Table 20 and 10 g of New Coal B 4 SN were added to distilled water to 1000 ml, the pH being adjusted to 10.0 to prepare a processing solution. Each of the light-sensitive materials was immersed and etched in a solution prepared by diluting by 2 times ELP-E with distilled water for 20 seconds and then immersed in the above described processing solution at 25° C. for 1 minute.

The thus resulting plate was subjected to printing under the same printing conditions as in Example 75. Any of the master plates gave clear image quality without fog on non-image areas even after printing 10000 prints.

TABLE 20

| Example | Light-sensitive Material | Nucleophilic Compound | Organic Solvent |
|---|---|---|---|
| 109 | Example 98 | sodium sulfite | benzyl alcohol |
| 110 | Example 76 | monoethanolamine | benzyl alcohol |
| 111 | Example 77 | diethanolamine | methyl ethyl ketone |
| 112 | Example 78 | thiomalic acid | ethylene glycol |
| 113 | Example 83 | thiosalicylic acid | benzyl alcohol |
| 114 | Example 79 | taurine | isopropyl alcohol |
| 115 | Example 93 | 4-sulfobenzene-sulfinic acid | benzyl alcohol |
| 116 | Example 100 | thioglycolic acid | ethanol |
| 117 | Example 104 | 2-mercaptoethyl-phosphonic acid | dioxane |
| 118 | Example 107 | 2-mercapto-1-aminoacetic acid | — |
| 119 | Example 108 | sodium thiosulfate | methyl ethyl ketone |
| 120 | Example 103 | ammonium sulfite | benzyl alcohol |

When the plate making was carried out in an analogous manner to Example 75, the resulting master plate for offset printing had a concentration of at least 1.0 and clear image quality. When it was subjected to an etching treatment and printing by a printing machine, 10000 or more prints with a clear image were obtained without occurrence of fog on non-image areas.

As illustrated above, according to the present invention, there is provided an electrophotographic lithographic printing plate, in which the effect by the hydrophilic property of non-image areas is further improved, and which is stable during storage even under very severe conditions and capable of readily realizing the hydrophilic property in a short time during processing for rendering hydrophilic, and which has very excellent electrostatic characteristics, printing property and printing durability.

What is claimed is:

1. A process for the production of an electrophotographic lithographic printing plate, comprising subjecting an electrophotographic photoreceptor to imagewise exposure and forming a toner image, said electrophotographic photoreceptor comprising an electroconductive support having provided thereon at least one photoconductive layer containing photoconductive inorganic compound and a binder resin, the binder resin comprising at least one of the following resins [P] and optionally at least one crosslinking agent, and then subjecting a non-image area of the photoconductive layer to an oil-desensitizing processing with a processing solution containing a hydrophilic compound containing a substituent having a Pearson's nucleophilic constant n of at least 5.5:

Resin [P]

Resin containing at least one of polymeric components each containing a functional group represented by the following General Formula ($I_0$):

General Formula ($I_0$):

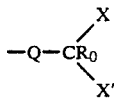

wherein X and X' are same or different groups at least one of which is an electron-attractive group and which have a sum of Hammet $\sigma_p$ values of at least 0.45, Q is COO or $SO_2$ and $R_0$ is hydrogen atom or an alkyl group having 1 to 6 carbon atoms.

2. A process for the production of an electrophotographic lithographic printing plate, comprising subjecting an electrophotographic photoreceptor to imagewise exposure and forming a toner image, said electrophotographic photoreceptor comprising an electroconductive support having provided thereon at east one photoconductive layer containing photoconductive inorganic compound and a binder resin, the binder resin comprising at least one of the following resins [P], optionally at least one of the following resins [B] and optionally at least one crosslinking agent, and then subjecting a non-image area of the photoconductive layer to an oil-desensitizing processing with a processing solution containing a hydrophilic compound containing a substituent having a Pearson's nucleophilic constant n of at least 5.5:

Resin [P]

Resin containing at least one of polymeric components each containing a functional group represented by the following General Formula ($I_0$):

General Formula ($I_0$):

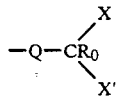

wherein X and X' are same or different groups at least one of which is an electron-attractive group and which have a sum of Hammet $\sigma_p$ values of at least 0.45, Q is COO or $SO_2$ and $R_0$ is hydrogen atom or an alkyl group having 1 to 6 carbon atoms, and Resin [B]

Heat and/or light-hardenable resin.

3. The process for the production of an electrophotographic lithographic printing plate, as claimed in claim 1 or claim 2, wherein the resin containing at least one of polymeric components each containing a functional group represented by the following General Formula ($I_0$) is previous crosslinked.

4. The process for production of an electrophotographic lithographic printing plate, as claimed in claim 1 or claim 2, wherein the hydrophilic compound containing a substituent having a Pearson's nucleophilic constant n of at least 5.5, the resin is at least one member selected from the group consisting of hydrazines, hydroxylamines, sulfites, thiosulfates, mercapto compounds containing at least one polar group selected from the group consisting of hydroxyl, carboxyl, sulfo, phosphono and amino groups, hydrazide compounds, sulfinic acid compounds and primary or secondary amine compounds.

5. The process for the production of an electrophotographic lithographic printing plate, as claimed in claim 1 or claim 2, wherein the electron attractive groups are selected from the group consisting of acyl, aroyl, formyl, alkoxy carbonyl, phenoxycarbonyl, alkylsulfonyl, aroylsulfonyl, nitro, cyano, halogenated alkyl, carbamoyl groups and halogen atoms.

6. The process for the production of an electrophotographic lithographic printing plate, as claimed in claim 1 or claim 2, wherein the polymeric component having at least one of the functional groups represented by General Formula ($I_0$) is represented by the following repeating unit of General Formula (III):

General Formula (III)

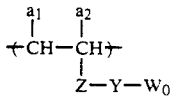

wherein Z represent

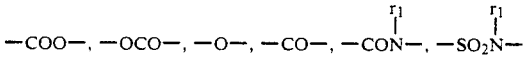

wherein $r_1$ represents a hydrogen atom or a hydrocarbon group, —CONHCOO—, —CONHCONH—, —$CH_2$COO—, —$CH_2$OCO— or

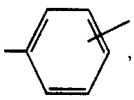

Y represents a direct bond or organic radical for connecting —Z— and —$W_o$, —Z—Y— can directly connect

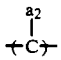

and —$W_o$, $W_o$ represents the functional group represented by General Formula ($I_0$) and $a_1$ and $a_2$ may be same or different, each being hydrogen atom, a halogen atom, cyano group, an alkyl group or an aryl group.

7. The process for the production of an electrophotographic lithographic printing plate, as claimed in claim 1 or claim 2, wherein the polymeric component having at least one of the functional groups represented by General Formula ($I_0$) is in a proportion of 1 to 95% by weight to the binder resin consisting of a copolymer.

8. The process for the production of an electrophotographic lithographic printing plate, as claimed in claim 1 or claim 2, wherein the polymeric component contains a crosslinking functional group in a copolymeric component containing at least one of the functional group represented by General Formula ($I_0$) or in another copolymeric component therefrom.

9. A lithographic printing plate precursor utilizing an electrophotographic photoreceptor comprising an electroconductive support having provided thereon at least one photoconductive layer containing photoconductive inorganic compound and a binder resin, the binder resin containing at least one resin containing at least one of polymeric components each containing a functional group represented by the following General Formula (II):

General Formula (II)

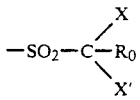

wherein X and X' are same or different groups at least one of which is an electron-attractive group and which have a sum of Hammet $\sigma_p$ values of at least 0.45, and $R_0$ is hydrogen atom or an alkyl group having 1 to 6 carbon atoms.

* * * * *